US012523453B2

(12) United States Patent
Heafitz et al.

(10) Patent No.: US 12,523,453 B2
(45) Date of Patent: Jan. 13, 2026

(54) PROJECTILES AND PROJECTILE DEPLOYMENT SYSTEMS

(71) Applicant: THE BOEING COMPANY, Arlington, VA (US)

(72) Inventors: Andrew Heafitz, Cambridge, MA (US); Laura Katarina Berk, Boulder, CO (US); Felipe Bohorquez, Cambridge, MA (US)

(73) Assignee: THE BOEING COMPANY, Arlington, VA (US)

( * ) Notice: Subject to any disclaimer, the term of this patent is extended or adjusted under 35 U.S.C. 154(b) by 0 days.

(21) Appl. No.: 18/738,880

(22) Filed: Jun. 10, 2024

(65) Prior Publication Data

US 2025/0377189 A1 Dec. 11, 2025

(51) Int. Cl.

| | |
|---|---|
| ***F42B 12/66*** | (2006.01) |
| ***F41H 11/02*** | (2006.01) |
| ***F41H 13/00*** | (2006.01) |
| ***F42B 6/10*** | (2006.01) |

(52) U.S. Cl.

CPC ..... *F41H 11/02* (2013.01); *F41H 13/0006* (2013.01); *F42B 6/10* (2013.01); *F42B 12/66* (2013.01)

(58) Field of Classification Search

CPC ..... F42B 12/66; F41H 13/0006
USPC ..... 102/504
See application file for complete search history.

(56) References Cited

U.S. PATENT DOCUMENTS

| | | | | |
|---|---|---|---|---|
| 1,191,713 A * | 7/1916 | McGill | F42B 12/66 | 102/504 |
| 2,372,383 A * | 3/1945 | Lee | F41H 13/0006 | 102/504 |
| 8,141,493 B1 * | 3/2012 | Kuchman | F42B 12/66 | 102/501 |

FOREIGN PATENT DOCUMENTS

| | | | | |
|---|---|---|---|---|
| AU | 2010257280 B1 * | 3/2011 | F42B 12/367 | |
| FR | 491876 A * | 6/1916 | F42B 12/66 | |
| GB | 105978 A * | 5/1917 | F42B 12/66 | |

OTHER PUBLICATIONS

"AeroGuard", SCI Technology, retrieved Mar. 19, 2024, https://www.sci.com/aeroguard/, pp. 1-5.
"Skynet Drone Defense," Maverick Drone Systems, retrieved Mar. 19, 2024, https://www.maverickdrone.com/products/skynet-drone-defense-3-pack, pp. 1-4.
DroneHunter F700, Fortem Technologies, retrieved Mar. 19, 2024, https://fortemtech.com/products/dronehunter-f700/, pp. 1-13.
Plotnikov, Michael, "The Application of Unmanned Aerial Systems in Surface Transportation—vol. II-E: Assessment of Unmanned Aircraft System Situational Awareness Technology to Support Applications in Surface Transportation" Massachusetts Department of Transportation, Dec. 2019, Report No. 19-010, pp. 1-44.

* cited by examiner

*Primary Examiner* — Jonathan C Weber
(74) *Attorney, Agent, or Firm* — Moore IP Law

(57) ABSTRACT

A projectile includes a shell defining a cavity and one or more retainers. A bolo is disposed within the cavity and a backplate is engaged with the one or more retainers. The backplate is configured to separate from the shell to release the bolo in response to imbalanced forces resulting from deploying the projectile.

33 Claims, 11 Drawing Sheets

PROJECTILES AND PROJECTILE DEPLOYMENT SYSTEMS

FIELD OF THE DISCLOSURE

The present disclosure is generally related to projectiles and projectile deployment systems.

BACKGROUND

As the cost, size, range, and capabilities of unpiloted and remotely piloted vehicles (collectively referred to herein as "uncrewed systems") have increased, these uncrewed systems are increasingly being used for information gathering and to otherwise obtain important and/or helpful data. There is also the reality, however, that such systems are being increasingly leveraged in adversarial or conflict situations. As a result, there is growing concern (e.g., among military and security entities) with being able to identify reliable yet also cost effective and safe methods for taking countermeasures against such systems if they are in fact used in conflict or adversarial settings.

The reality, however, is there are a variety of challenges associated with securing an area against uncrewed systems when necessary. For example, the uncrewed systems tend to be cheaper and more readily available than systems that are used to defend against such uncrewed systems. An additional concern is dangers associated with use of the defense system itself. For example, using projectiles to attempt to disable an uncrewed system is difficult and costly, and in many cases there is an accompanying risk or collateral damage being caused to people and/or property in the vicinity.

To address the problem of collateral damage, "low-collateral" unmanned system disabling approaches have been attempted. One such approach is to use specially designed devices to deploy nets or netting. While this approach may reduce the risk of collateral damage in certain instances, it generally requires the use of relatively expensive projectiles and/or special-purpose equipment. Moreover, the nets are large and heavy, in turn requiring that the disabling devices which carry and deploy such nets to be much larger than is desired. This added size is problematic both from a cost perspective and in terms of rendering the disabling devices more susceptible to being thwarted by unmanned systems acting to counter the disabling devices. Further, due to the size and weight of such nets, the number of nets available for use may be limited. For example, a disabling device may only be capable of carrying a very small number of nets.

SUMMARY

According to one implementation of the present disclosure, a projectile includes a shell defining a cavity and one or more retainers. The projectile also includes a bolo disposed within the cavity and a backplate engaged with the one or more retainers. The backplate is configured to separate from the shell to release the bolo in response to imbalanced forces resulting from deploying the projectile.

According to another implementation of the present disclosure, a system includes a barrel including a breech and a muzzle. The system also includes an ammunition feed system coupled to the barrel and configured to provide projectiles to the breech of the barrel. The system further includes one or more projectiles disposed within the ammunition feed system. The one or more projectiles include a shell defining a cavity and one or more retainers. The one or more projectiles also include a bolo disposed within the cavity and a backplate engaged with the one or more retainers. The backplate is configured to separate from the shell to release the bolo in response to imbalanced forces resulting from deploying the projectile.

According to another implementation of the present disclosure, a method of operation of a projectile includes, responsive to high-pressure gas during deployment of a projectile from a barrel, disengaging a backplate of the projectile from one or more retainers of a shell of the projectile to enable introduction of a portion of the high-pressure gas into a cavity defined by the shell and moving the projectile along the barrel toward a muzzle of the barrel. The method also includes, responsive to an internal pressure of the shell sufficiently exceeding a pressure behind the backplate, separating the backplate from the shell to deploy a bolo disposed within the shell.

The features, functions, and advantages described herein can be achieved independently in various implementations or may be combined in yet other implementations, further details of which can be found with reference to the following description and drawings.

DETAILED DESCRIPTION

Figure 1A:
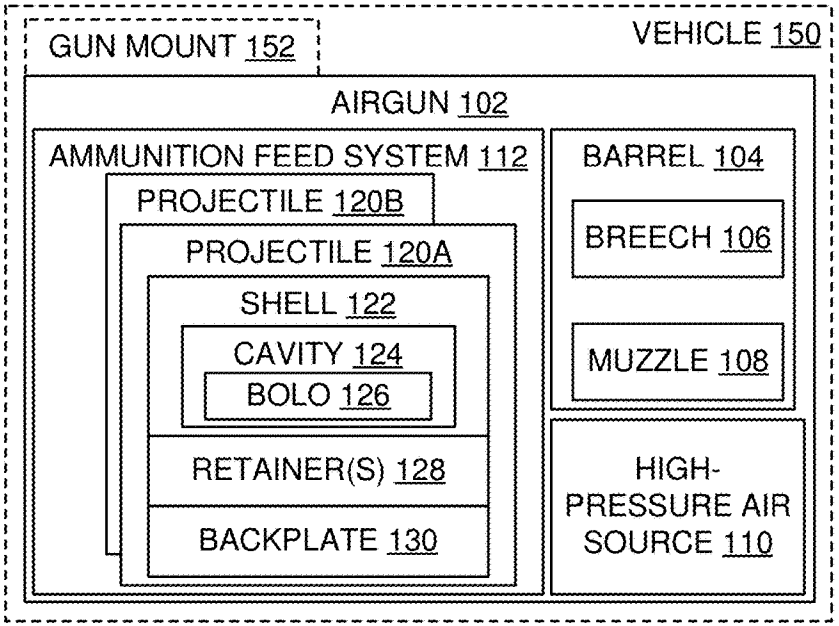
FIG. 1A is a block diagram of a system that includes an airgun and projectiles that can be deployed by the airgun.

The present disclosure describes a projectile that is configured to defeat or disable a target such that the target can no longer serve its intended purpose. The term "target" refers to a moving object such a vehicle (e.g., an aerial vehicle such as a drone, an uncrewed vehicle, UAV, or other autonomous or unmanned vehicle), with the target being defeated or disabled by virtue of sufficiently interfering with or preventing the target from being able to operate (e.g., by the target becoming sufficiently entangled with at least a portion of the projectile).

The projectile is configured to be deployed (e.g., launched or fired) by a relatively compact, inexpensive, and readily available deployment system, such as a paintball gun or a similar airgun. Because the projectiles can be very inexpensive, this arrangement can reduce the cost of engaging a target, ideally reducing the cost of engaging the target to less than the cost of operating the target. Having the deployment system coupled to a vehicle allows use of the projectile away from locations of importance. Further, projectiles are configured to be rapidly fired by such deployment systems, in turn enabling rapid fire of multiple projectiles against one or more targets. The use of multiple projectiles increases the likelihood of successfully disabling or defeating one or more targets. The projectile is also configured to be non-lethal and to cause little or no collateral damage to people or property in a vicinity of use. As a result of the above, the projectile can be effectively used as a countermeasure against desired targets.

In particular, the projectile is configured to deploy a bolo or similar entanglement device to entangle a portion of a target. To illustrate, when deployed against a UAV, the bolo can entangle a propeller, a control surface, and/or another component of the UAV in order to disable lift or control of the UAV.

As an example use case, a target UAV can include a commercially available quadcopter, which optionally can be modified for surveillance or outfitted with a payload. In this example, an objective of a defensive system is to stop the target UAV before it gets to its destination or defined/defended area. In this example, the effective range of many ground-based low-collateral systems is too limited to engage the UAV before it presents a threat to the defended area. On the other hand, high-collateral systems may engage the UAV while it is sufficiently far away, but these high-collateral systems themselves can pose a threat to personnel, civilians, property, etc. One solution to this dilemma is to mount a low-collateral system on an interceptor vehicle to enable the low-collateral system to engage the target UAV at a greater range from the defended area. However, one challenge of such solutions is providing a low-collateral system that is sufficiently lightweight to be deployed in this manner. Another challenge is that many low-collateral systems have limited ammunition, often a single net, meaning that such systems can only engage a single target and cannot make multiple attempts to defeat a target (e.g., by firing multiple nets), which decreases the likelihood of success. In some cases, multiple UAVs (e.g., a swarm) can approach the defended area from multiple kilometers away at velocities typical of a quadcopter (10-20 m/s) and pose a threat at a significant range. An ability to deploy multiple projectiles enables the defense system to handle multiple UAVs.

The disclosed systems address each of these challenges by providing a system (e.g., an airgun and projectiles) that is lightweight and capable of rapidly deploying multiple countermeasures (e.g., bolos or similar entanglement devices) with the goal of defeating or at least disabling a target. This arrangement enables a single interceptor outfitted with the system to engage multiple targets, increasing the likelihood of successfully engaging each target, and reducing the cost of such engagements, while negating or substantially diminishing the risk of collateral damage.

As one example, the disclosed system uses an airgun, such as a commercial off-the-shelf (COTS) paintball gun, that is capable of rapidly firing multiple projectiles. The disclosed system also includes a projectile that is configured to be fired by the airgun and configured to deploy a bolo. In a particular embodiment, to facilitate a rapid rate of fire and to reduce complexity of the airgun, the projectile is designed such that an entirety of the projectile exits the muzzle of the airgun when the projectile is deployed (e.g., fired). For example, no casing of the projectile remains in a barrel of the airgun when the projectile is deployed. As a result, the airgun does not need an ejection mechanism to clear the barrel prior to an ammunition feed system (e.g., a magazine) loading the next projectile in the barrel.

The projectile can be considered an air-bursting, kinetic projectile. In a particular aspect, the projectile includes a shell defining a cavity for a bolo. When the projectile is fired, pressurized air from the airgun can enter the cavity causing the projectile to "burst" (e.g., separate into two or more pieces) to deploy the bolo after the projectile clears the barrel of the airgun. Using air pressure from the airgun to burst the projectile means that the projectile does not need to include any explosive component. As one example, a backplate can be coupled to the shell, and a difference between ambient air pressure outside the barrel and a pressure within the cavity (due to firing the projectile) can cause the backplate to separate from the shell. The shell may also, or alternatively, separate into multiple pieces to deploy the bolo.

The bolo includes one or more lines (e.g., Kevlar fibers) and two or more weights. The bolo is configured to spread or splay out after it is released from the projectile, enabling the bolo to be of suitable shape and surface area as to be likely to successfully entangle a component of the target so as to disable or defeat the target. In a particular aspect, the line(s) of the bolo can include a relatively lightweight material that is durable enough (i.e., to remain sufficiently intact) to withstand entanglement in a moving propeller or similar component of the target. For example, the line(s) can include Kevlar or a similar lightweight and durable polymer. In a particular example, the weights of the bolo are formed of copper wick, or another low cost material that can be compressed or otherwise shaped as needed for storage within the projectile. In some embodiments, one or more of the weights can be integrated within or coupled to the shell of the projectile.

In some embodiments, the bolo can include additional components, such as one or more stabilizer components (e.g., ribbons or low density foam) configured to provide drag that helps facilitate spread of the bolo. Additionally, or alternatively, a portion of the shell of the projectile, one or more of the weights, or both, can be shaped to facilitate spread of the bolo. A weight and/or a portion of the shell of the projectile can have a lifting body shape to generate a lateral component of force relative to a primary direction of travel of the bolo.

The figures and the following description illustrate specific examples of projectiles, projectile deployment systems, and methods of their use. It will be appreciated that those skilled in the art will be able to devise various arrangements that, although not explicitly described or shown herein, embody the principles described herein and are included within the scope of the claims that follow this description. Furthermore, any examples described herein are intended to aid in understanding the principles of the disclosure and are to be construed as being without limitation. As a result, this disclosure is not limited to the specific embodiments or examples described below, but by the claims and their equivalents.

Particular implementations are described herein with reference to the drawings. In the description, common features are designated by common reference numbers throughout the drawings. In some drawings, multiple instances of a particular type of feature are used. Although these features are physically and/or logically distinct, the same reference number is used for each, and the different instances are distinguished by addition of a letter to the reference number. When the features as a group or a type are referred to herein (e.g., when no particular one of the features is being referenced), the reference number is used without a distinguishing letter. However, when one particular feature of multiple features of the same type is referred to herein, the reference number is used with the distinguishing letter. For example, referring to FIG. 1B, multiple weights are illustrated and associated with reference numbers 132A and 132B. When referring to a particular one of these weights, such as the weights 132A, the distinguishing letter "A" is used. However, when referring to any arbitrary one of these weights or to these weights as a group, the reference number 132 is used without a distinguishing letter.

As used herein, various terminology is used for the purpose of describing particular implementations only and is not intended to be limiting. For example, the singular forms "a," "an," and "the" are intended to include the plural forms as well, unless the context clearly indicates otherwise. Further, some features described herein are singular in some implementations and plural in other implementations. For ease of reference herein, such features are generally introduced as "one or more" features and may subsequently be referred to in the singular or optional plural (as typically indicated by "(s)") unless aspects related to multiple of the features are being described.

The terms "comprise," "comprises," and "comprising" are used interchangeably with "include," "includes," or "including." Additionally, the term "wherein" is used interchangeably with the term "where." As used herein, "exemplary" indicates an example, an implementation, and/or an aspect, and should not be construed as limiting or as indicating a preference or a preferred implementation. As used herein, an ordinal term (e.g., "first," "second," "third," etc.) used to modify an element, such as a structure, a component, an operation, etc., does not by itself indicate any priority or order of the element with respect to another element, but rather merely distinguishes the element from another element having a same name (but for use of the ordinal term). As used herein, the term "set" refers to a grouping of one or more elements, and the term "plurality" refers to multiple elements.

As used herein, "generating," "calculating," "using," "selecting," "accessing," and "determining" are interchangeable unless context indicates otherwise. For example, "generating," "calculating," or "determining" a parameter (or a signal) can refer to actively generating, calculating, or determining the parameter (or the signal) or can refer to using, selecting, or accessing the parameter (or signal) that is already generated, such as by another component or device. As used herein, "coupled" can include "communicatively coupled," "electrically coupled," or "physically coupled," and can also (or alternatively) include any combinations thereof. Two devices (or components) can be coupled (e.g., communicatively coupled, electrically coupled, or physically coupled) directly or indirectly via one or more other devices, components, wires, buses, networks (e.g., a wired network, a wireless network, or a combination thereof), etc. Two devices (or components) that are electrically coupled can be included in the same device or in different devices and can be connected via electronics, one or more connectors, or inductive coupling, as illustrative, non-limiting examples. In some implementations, two devices (or components) that are communicatively coupled, such as in electrical communication, can send and receive electrical signals (digital signals or analog signals) directly or indirectly, such as via one or more wires, buses, networks, etc. As used herein, "directly coupled" is used to describe two devices that are coupled (e.g., communicatively coupled, electrically coupled, or physically coupled) without intervening components.

Figure 1B:
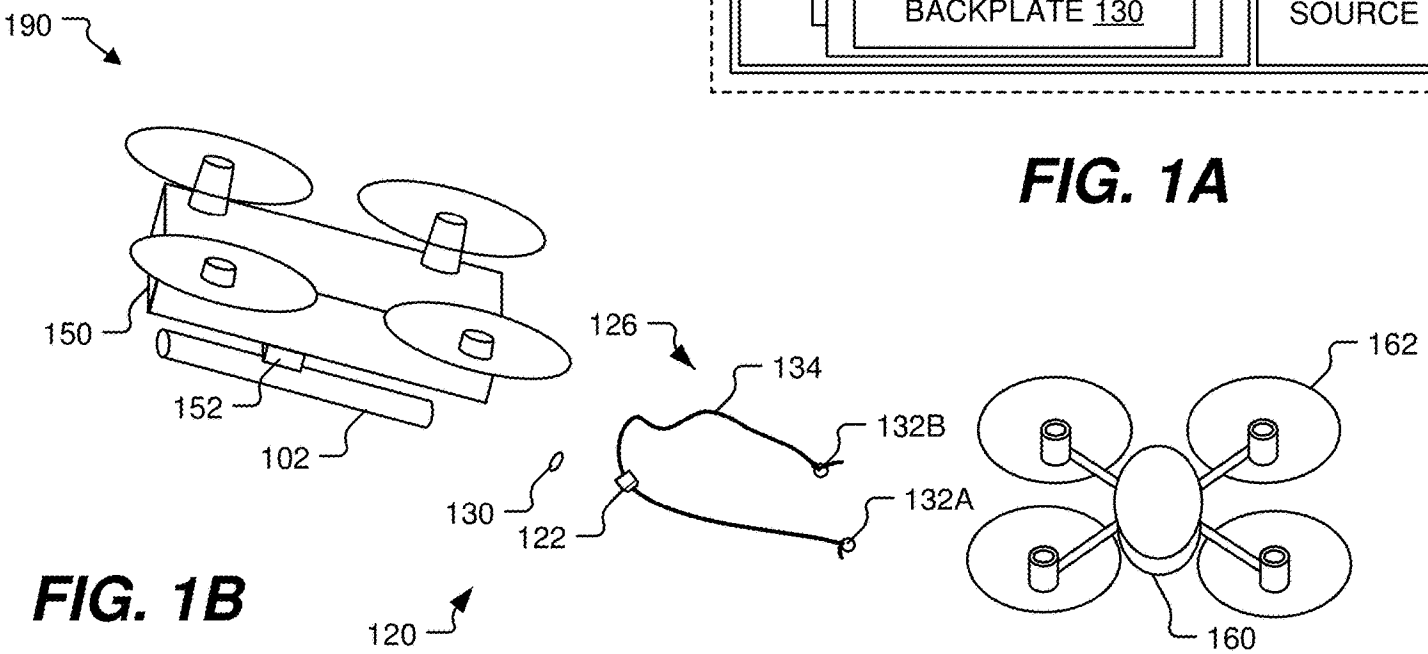
FIG. 1B illustrates a specific example of a system in which the airgun of FIG. 1A is mounted on a vehicle and configured to deploy the projectiles toward a target.

FIG. 1A is a block diagram illustrating an airgun 102 that is configured to deploy projectiles 120 (e.g., projectiles 120A and 120B in the example illustrated). As illustrated in FIG. 1A, the airgun 102 can optionally be mounted, via a gun mount 152, to a vehicle 150. FIG. 1B illustrates an example of a system 190 in which the vehicle 150 corresponds to an aircraft, which may be autonomous, semi-autonomous, or remotely piloted. In other examples, the airgun 102 can be mounted to a different type of vehicle (e.g., a piloted aircraft, a land vehicle, or a water vehicle). In still other examples, the airgun 102 can be mounted at a stationary location or can be portable (e.g., carried and used by one or more people).

The airgun 102 includes a barrel 104, an ammunition feed system 112, and a high-pressure air source 110. In this context, "high-pressure" refers to a pressure that is greater than ambient pressure by an amount that is sufficient to enable the airgun 102 to deploy (e.g., fire) projectiles 120 from the barrel 104 in the manner described below. The specific pressure required can vary depending on the characteristics of the projectiles 120, characteristics of the barrel 104, and other factors. Further, the term "airgun" should be understood broadly to cover devices that use high-pressure gas (e.g., air, nitrogen, carbon dioxide, or any other convenient gas or gas mix) to deploy (e.g., fire) projectiles (e.g., the projectiles 120) from one or more barrels (e.g., the barrel 104). For example, the airgun 102 can include a paintball gun that is configured to use paintballs or similar ammunition, and the projectiles 120 are sized and shaped accordingly (e.g., to a size, shape, and weight that can be fired by a paintball gun). In a particular embodiment, the airgun 102 is a magazine-fed paintball gun configured to fire shaped paintball ammunition, such as FIRST STRIKE™ paintballs (FIRST STRIKE is a registered trademark of UNITED TACTICAL SYSTEMS, LLC).

The ammunition feed system 112 is configured to retain a plurality of projectiles 120 (e.g., a projectile 120A and a projectile 120B in FIG. 1A). Although only two projectiles 120 are illustrated in FIG. 1A, the ammunition feed system 112 can be configured to retain more than two projectiles 120 (e.g., three, five, ten, twenty, or some other number of projectiles 120). The ammunition feed system 112 is also configured to provide the projectiles 120, one at a time, to a breech 106 end of the barrel 104. To wit, the airgun 102 is a breech-loaded airgun, and the projectiles 120 are breech-loadable. As an example, the ammunition feed system 112 can include a magazine that retains the projectiles 120 in a specific orientation relative to the barrel 104 and advances each projectile 120 into the breech 106 when a receiver port of the breech 106 is open.

The projectiles 120 each include a shell 122, one or more retainers 128, and a backplate 130. The shell 122 of each projectile 120 defines a cavity 124 in which a bolo 126 is disposed. The retainer(s) 128 are configured to retain the backplate 130, which retains the bolo 126 within the cavity 124. For example, the retainer(s) 128 can include one or more tabs, one or more ridges, or both. In some embodiments, the bolo 126 is wrapped, curled, or otherwise disposed within the cavity 124 in a manner that tends to urge the backplate 130 toward (e.g., against) the retainer(s) 128.

As described further below, the projectile 120 is operable to release the backplate 130 responsive to deployment of the projectile 120 from a muzzle 108 of the barrel 104. For example, before being fired, the backplate 130 is configured to engage the one or more retainer(s) 128 such that the backplate 130 remains coupled to the shell 122 and confines the bolo 126 within the cavity 124. Further, the backplate 130 is configured to, when the projectile 120 is deployed, separate from the shell 122 to release the bolo 126 in response to imbalanced forces resulting from deploying the projectile 120. To illustrate, the backplate 130 is configured, while traveling down the barrel 104 during deployment of the projectile 120, to permit high-pressure air to enter the cavity 124, and, after exiting the barrel 104, to flex so as to disengage from the retainer(s) 128 due, at least in part, to a pressure differential existing between the high-pressure air in the cavity 124 and ambient air pressure. In some embodiments, a weight of the bolo 126 is positioned within the cavity 124 near a center of the backplate 130 such that inertia of the weight tends, while the projectile 120 is traveling down the barrel 104 during deployment of the projectile, to flex the backplate 130 to facilitate disengagement of the backplate 130 from the retainer(s) 128.

In this context, the term "bolo" refers to a device or system that includes two or more weights coupled to one or more lines (e.g., strings, ropes, cords, cables, ribbons, fibers, or other similar flexible, elongated members). Bolos of this type are also commonly referred to as "bolas". In some embodiments, one or more of the weights of the bolo 126 are coupled to or integral with at least a portion of the shell 122. For example, at least a first weight of two or more weights of the bolo 126 may be attached to or integral with at least a portion of the shell 122, and at least a second weight of the two or more weights is not attached to and is not integral with any portion of the shell 122. In some embodiments, the bolo 126 includes two or more lines and weights coupled to ends of the two or more lines.

As described further below, each projectile 120 is configured to release its bolo 126 when the projectile 120 is deployed (e.g., fired) by the airgun 102. Thus, the bolos 126 can be used to entangle a portion of a target to defeat, disable, or otherwise limit or deter successful continued operation of the target. Each bolo 126 is configured to spread or splay as it is deployed. For example, depending on the arrangement of weights, lines, and possibly other components, a bolo 126 can be configured to deploy in a substantially U-shape, a substantially W-shape, or a substantially X-shape, or some other shape (e.g., a substantially radial shape having two or more arms extending from a center) conductive to serving its intended purpose. If there is more than one projectile 120 contained within the airgun 102, the shape of the bolos released by the projectiles can vary—that is, it is not required that all projectiles which are or may be fired from the same airgun have bolos which are configured to deploy in the same manner.

In some embodiments, the shell 122 is formed of or includes a polymer. The retainer(s) 128 can be coupled to or integral with the shell 122. For example, the shell 122 and retainer(s) 128 can be cast, molded, or printed together. In some embodiments, the shell 122 includes one or more internal structures that are configured to inhibit entanglement of one or more lines of the bolo 126 while the bolo 126 is disposed within the cavity 124. The shell 122 can also include or define other features, such as openings to receive one or more weights that are coupled to portions of the shell 122, openings through which one or more of the lines of the bolo 126 extend to couple to one or more weights, etc.

In some embodiments, the shell 122 includes or is formed of multiple segments that are configured to separate from one another in response to separation of the backplate 130 from the retainer(s) 128. In some such embodiments, one or more of the segments is coupled to a portion of the bolo 126. For example, a weight of the bolo 126 can be coupled to or retained within (e.g., integral with) the segment. One or more of the segments may have an aerodynamic shape that is configured to generate a lateral force to improve spread of the bolo 126. To illustrate, a segment can have a wedge shape or lifting body shape that generates a force lateral with respect to a primary direction of travel of the bolo 126 in order to help spread the bolo 126. In embodiments in which the shell 122 includes multiple segments, the projectile 120 can include a mechanism configured to be actuated by relative motion during separation of the backplate 130 and the shell 122. For example, the projectile 120 can include one or more segment retainers coupled to the backplate 130 and configured to join the multiple segments of the shell 122 to one another before the projectile is deployed and configured to release the multiple segments from one another in response to separation of the backplate 130 from the retainer(s) 128.

For example, in FIG. 1B, the projectile 120 has been fired at a target vehicle 160. In this example, the backplate 130 has separated from the shell 122 of the projectile 120 to release the bolo 126. The bolo 126 has deployed from the cavity 124 of the shell 122 and inertial and/or aerodynamic characteristics of the bolo 126 have caused the bolo 126 to spread or splay to increase the likelihood that the bolo 126 will entangle a portion (e.g., one or more propellers 162) of the target vehicle 160. The bolo 126 includes one or more lines 134 coupled to two or more weights 132 (e.g., weights 132A and 132B in FIG. 1B).

Thus, in the examples illustrated in FIGS. 1A and 1B, the projectiles 120 are configured to release the bolos 126 when deployed from the barrel 104 of the airgun 102. The projectiles 120 are breech-loadable (e.g., configured to be loaded into the barrel 104 via the breech 106 end of the barrel 104) and are configured to clear the barrel 104 entirely when deployed. For example, when the projectile 120A is deployed from the muzzle 108 end of the barrel 104 no portion of the projectile 120A or any component previously attached to the projectile 120A remains in the barrel 104, enabling firing of a second projectile 120B right away, enabling firing of a third projectile right away after the second projectile, and so on. Thus, after deploying the projectile 120A from the barrel 104, the barrel 104 is clear and ready to receive and deploy a subsequent projectile 120B without the need to eject a casing or other component of the projectile 120A.

Moreover, since nothing needs to be cleared from the barrel 104 after each projectile 120 is deployed, the airgun 102 does not need an ejection system (e.g., a mechanism to remove a spent casing or shell associated with a projectile), which reduces the complexity and weight of the airgun 102. Additionally, entirely clearing the barrel 104 during firing of each projectile 120 can enable the airgun 102 to rapidly fire multiple projectiles 120 from a single barrel 104, which increases the likelihood of a target (e.g., the target vehicle 160) being successfully engaged.

Figure 2A:
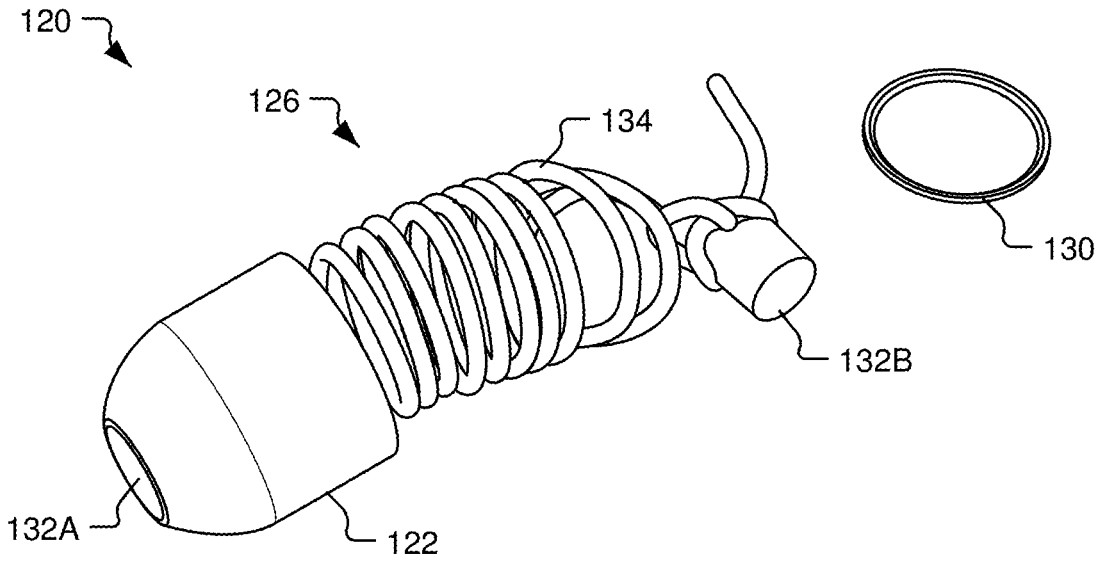
FIGS. 2A and 2B illustrate a particular example of the projectile of FIG. 1A.
Figure 2B:
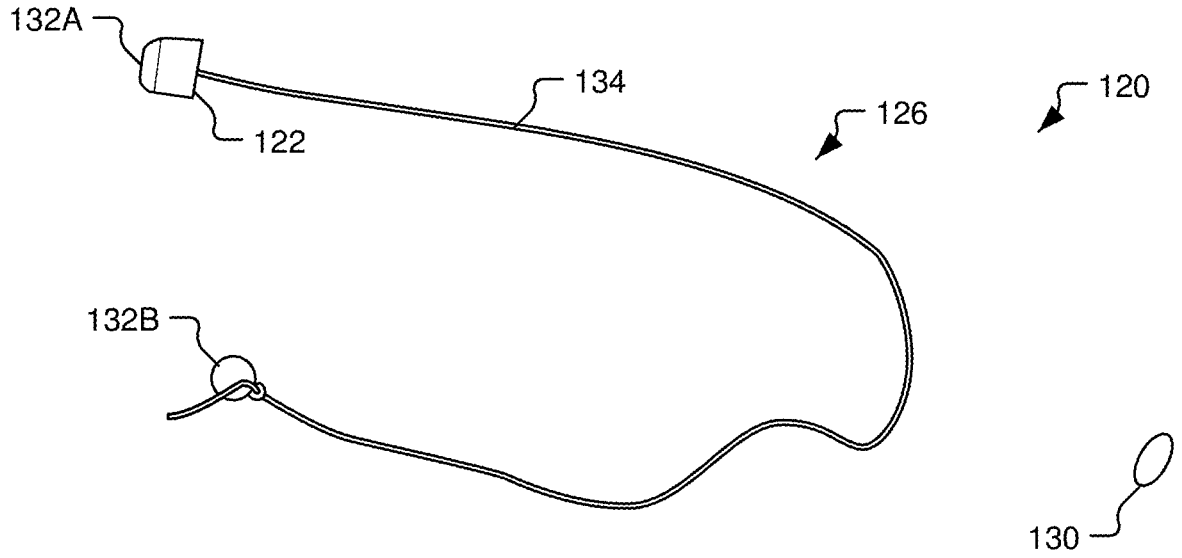

FIGS. 2A and 2B illustrate an example of the projectile 120. In FIG. 2A, the backplate 130 is detached from the shell 122 and the bolo 126 is partially deployed. In FIG. 2B, the bolo 126 of FIG. 2A is fully deployed and spread/splayed (e.g., into a substantially U-shape). In each of FIGS. 2A and 2B, one weight 132A of the bolo 126 is coupled to the shell 122, and another weight 132B of the bolo 126 is coupled to the line 134 opposite the weight 132A.

Figure 3A:
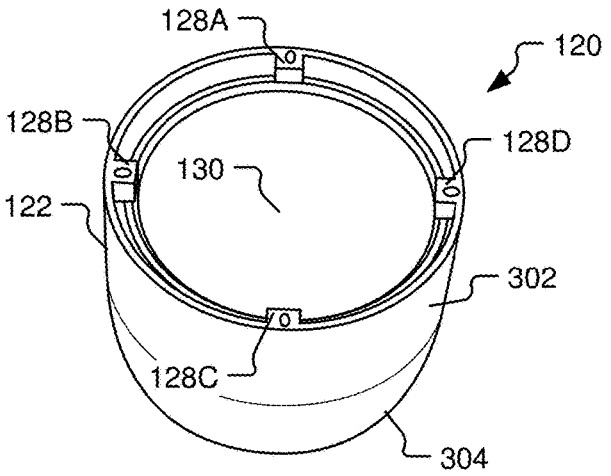
FIG. 3A illustrates a perspective bottom view of an example of the projectile of FIG. 1A.
Figure 3B:
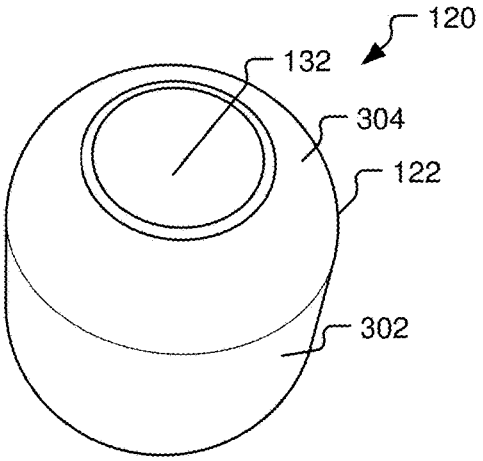
FIG. 3B illustrates a perspective top view of the projectile of FIG. 3A.
Figure 3C:
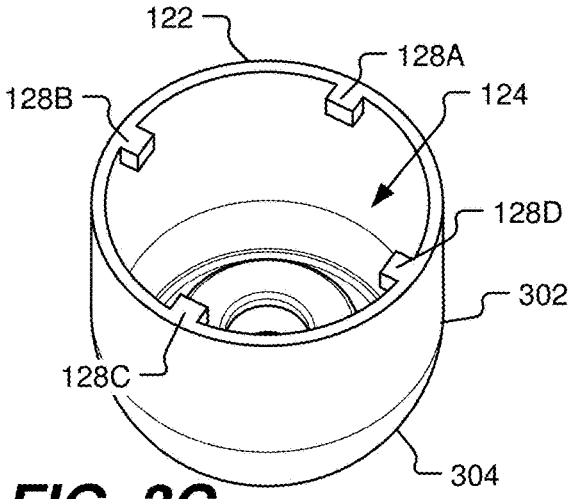
FIG. 3C illustrates a perspective bottom view of a shell of the projectile of FIG. 3A.
Figure 3D:
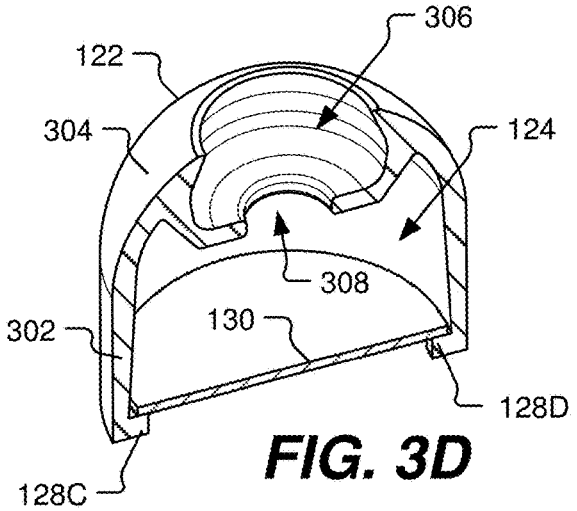
FIG. 3D illustrates a cross-sectional view from a top perspective of a shell and backplate of the projectile of FIG. 3A.
Figure 3E:
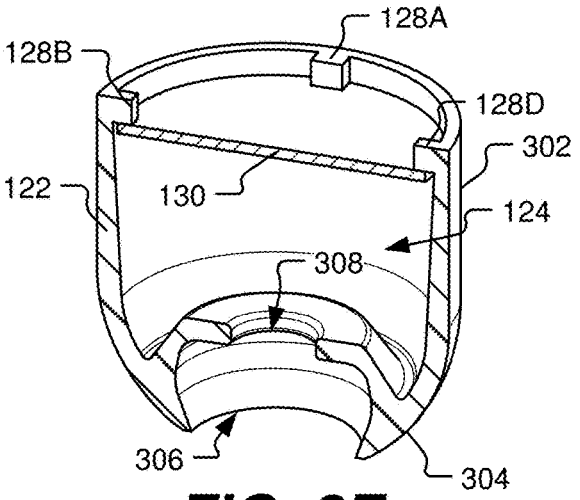
FIG. 3E illustrates a cross-sectional view from a bottom perspective of the shell and backplate of the projectile of FIG. 3A.
Figure 3F:
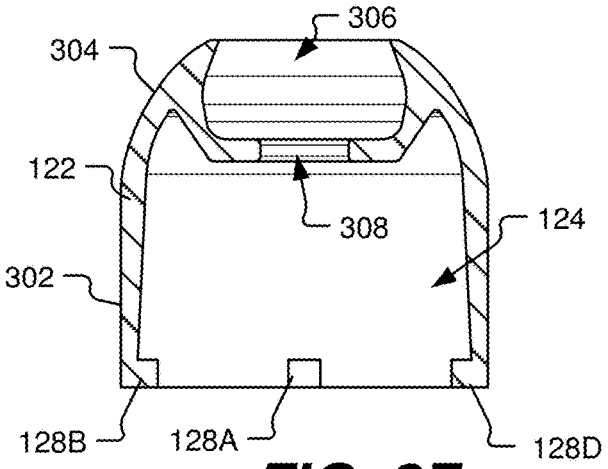
FIG. 3F illustrates a cross-sectional view from a side perspective of the shell of the projectile of FIG. 3A.

FIGS. 3A and 3B illustrate a perspective bottom view and a perspective top view, respectively, of one embodiment of the projectile 120 of FIG. 1. FIGS. 3C-3F illustrate various views of the shell 122 of the projectile 120 of FIGS. 3A and 3B. In particular, FIG. 3C shows a perspective bottom view of the projectile 120 without the backplate 130. FIG. 3D shows a cross-sectional view from a top perspective of the shell 122 and the backplate 130 of FIGS. 3A and 3B. FIG. 3E shows a cross-sectional view from a bottom perspective of the shell 122 and the backplate 130 of FIGS. 3A and 3B. FIG. 3F shows a cross-sectional view from a side perspective of the shell 122 of FIGS. 3A and 3B.

In the embodiment illustrated in FIGS. 3A-3F, the shell 122 is shaped in a manner that improves aerodynamics of the projectile 120. For example, the shell 122 has a nose cone 304 that is curved or contoured along a direction of travel of the projectile 120, and a body 302 that is substantially flat or gradually sloped along the direction of travel of the projectile 120. In some embodiments, the body 302 is shaped to give the cavity 124 a slightly larger diameter at an end near the retainer(s) 128 than at an end near the nose cone 304 to facilitate deployment of components of the bolo 126 through a rear of the projectile 120.

Additionally, in FIGS. 3A-3F, the retainer(s) 128 (e.g., retainers 128A, 128B, 128C, and 128D) are illustrated as tabs formed on an inner surface of the shell 122. In this example, the backplate 130 is round with a diameter that is selected to fit within the shell 122 and rest on the retainer(s) 128 before the projectile 120 is deployed (e.g., fired). The backplate 130 is sufficiently flexible to enable the backplate 130 to flex and move past the retainer(s) 128 due to imbalanced forces during deployment of the projectile 120 to separate the backplate 130 from the shell 122. For example, the backplate 130 can include a relatively flat polymer disk.

In the embodiment illustrated in FIGS. 3A-3F, the shell 122 defines a recess 306 in the nose cone 304 to retain a weight 132 (shown in FIG. 3B) of the bolo 126, and an opening 308 between the recess 306 and the cavity 124. The opening 308 allows one or more lines 134 of the bolo 126 to be coupled to the weight 132 through the shell 122. In other embodiments, recess 306 is positioned internal to the cavity 124 such that the weight 132 is coupled to the shell 122 within the cavity 124, in which case the opening 308 might not be present.

Figure 4C:
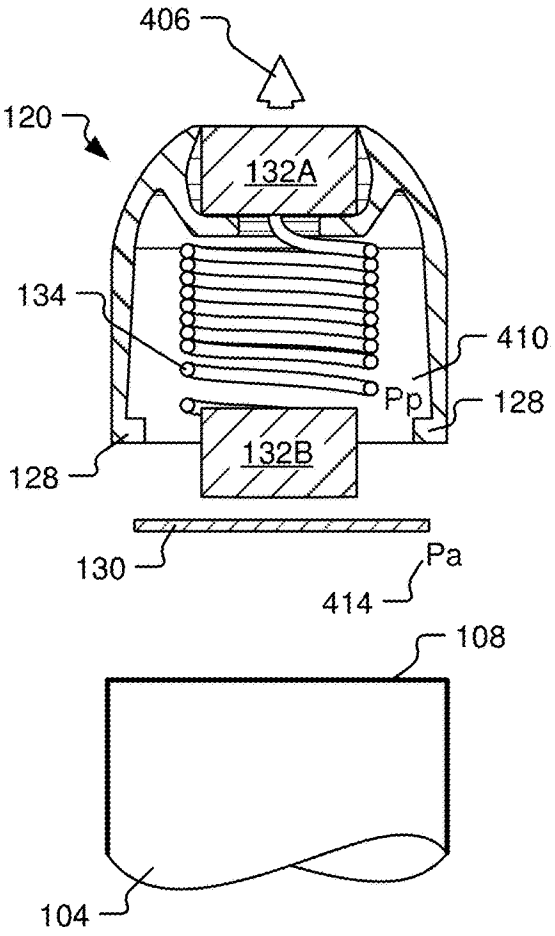
FIGS. 4A, 4B, and 4C, together, illustrate an example of a sequence of stages during deployment of the projectile of FIG. 1A from a barrel.
Figure 4B:
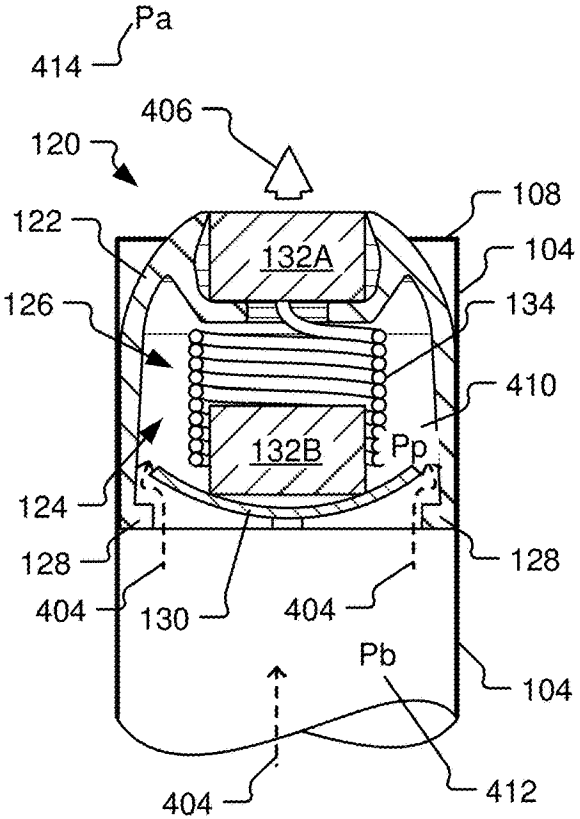
Figure 4A:
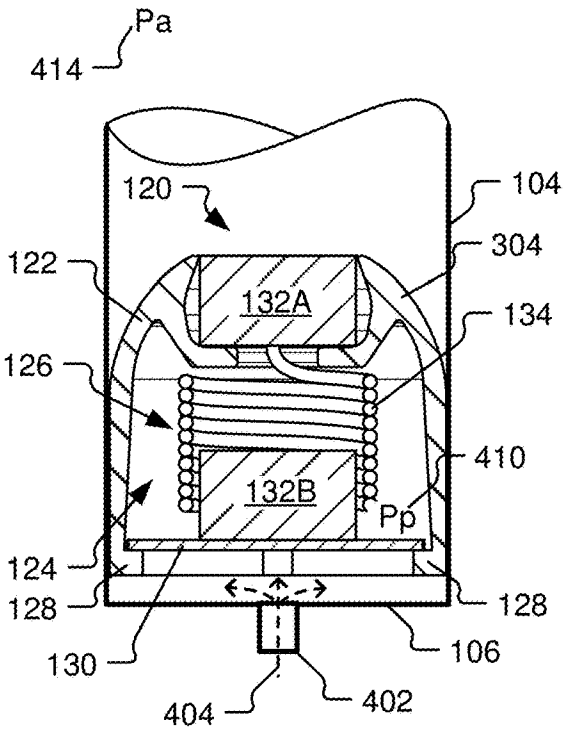

FIGS. 4A-4C illustrate an exemplary sequence of stages during deployment of the projectile 120 from a barrel 104. The various stages are illustrated in schematic cross-sectional views.

In FIGS. 4A-4C, the projectile 120 includes the bolo 126 disposed in the cavity 124 of the shell 122. The projectile 120 also includes the backplate 130 and the retainer(s) 128. In FIGS. 4A-4C, a weight 132A of the bolo 126 is disposed in a nose cone 304 of the shell 122. Another weight 132B of the bolo 126 is disposed within the cavity 124 (e.g., on the backplate 130), and a line 134 of the bolo 126 is coiled in the cavity 124 and coupled to each of the weights 132. Thus, the projectile 120 illustrated in FIGS. 4A-4C has a configuration similar to the projectile 120 illustrated in FIGS. 3A-3F; however, the sequence of stages illustrated in FIGS. 4A-4C is similar for projectiles 120 having other configuration.

FIG. 4A illustrates a first stage in the sequence during deployment of the projectile 120. In this example, the first stage corresponds to a time early during deployment of the projectile 120. For example, in FIG. 4A, high-pressure air 404 has begun to be released from an inlet 402 into the barrel 104, but the projectile 120 has not started to move down the barrel 104.

In FIG. 4A, the projectile 120 is positioned in the breech 106 of the barrel 104 such that the nose cone 304 is oriented toward the muzzle (shown in FIGS. 4B and 4C) of the barrel 104. The backplate 130 is in contact with the retainer(s) 128. For example, the bolo 126 or a portion thereof (such as the weight 132B) can be in contact with an inner surface of the backplate 130 and may tend to urge the backplate 130 toward the retainer(s) 128. Additionally, an air pressure (Pp) 410 in the cavity 124 is approximately equal to an ambient air pressure (Pa) 414 in or near the barrel 104.

FIG. 4B illustrates a second stage in the sequence during deployment of the projectile 120. In the second stage of FIG. 4B, more high-pressure air 404 has entered the barrel 104 behind the projectile 120. As a result, a difference between the ambient air pressure Pa 414 and a barrel pressure (Pb) 412 has increased sufficiently to move the projectile 120 in direction 406 through the barrel 104 toward the muzzle 108 of the barrel 104.

Additionally, in FIG. 4B, a difference between the barrel pressure Pb 412 and the pressure Pp 410 in the cavity 124 has caused the backplate 130 to flex or move to separate from the retainer(s) 128 sufficiently to allow high-pressure air 404 to enter the cavity 124, which increases the pressure Pp 410 in the cavity 124. The increase in the pressure Pp 410 in the cavity 124 facilitates deployment of the bolo 126, as explained further with reference to FIG. 4C. Additionally, the increase in the pressure Pp 410 in the cavity 124 may tend to flex the shell 122, improving a seal between the projectile 120 and the barrel 104, which in turn reduces leakage of high-pressure air 404 around the projectile 120 and enables a high exit velocity of the projectile 120 from the barrel 104.

FIG. 4C illustrates a third stage in the sequence during deployment of the projectile 120. In the third stage of FIG. 4C, the projectile 120 has exited the muzzle 108 of the barrel 104. In a particular aspect, an entirety of the projectile 120 exits through the muzzle 108 when the projectile 120 is deployed (e.g., fired). Accordingly, no component of the projectile 120 and no component previously attached to the projectile 120 (such as a casing or a sabot) remains in the barrel 104 after the projectile 120 exits the muzzle 108. Therefore, at the third stage, the barrel 104 is ready to immediately receive another projectile 120 from the ammunition feed system 112 of FIG. 1 without having to empty any contents from the barrel 104.

When the projectile 120 leaves the barrel 104, a pressure behind the backplate 130 is the ambient air pressure Pa 414, which is less than the pressure Pp 410 in the cavity 124 due to introduction of the high-pressure air 404 into the cavity 124 while the shell 122 was moving down the barrel 104, as in FIG. 4B. The difference in the ambient air pressure Pa 414 and the pressure Pp 410 in the cavity 124 results in imbalanced forces on the backplate 130, which alone, or in combination with force applied to the backplate 130 by the weight 132B, causes the backplate 130 to flex or slide past the retainers 128 and separate from the shell 122. After separation of the backplate 130 from the shell 122, the backplate 130 may return to a flat shape and may continue to move away from the barrel 104.

After the backplate 130 separates from the shell 122, the bolo 126 begins to deploy from the shell 122 due to inertia of the line 134, the weight 132B, or both. As the bolo 126 deploys from the shell 122, it tends to spread to a deployed shape due to inertia of the weights 132, inertia of the line 134, drag, etc.

Figure 5A:
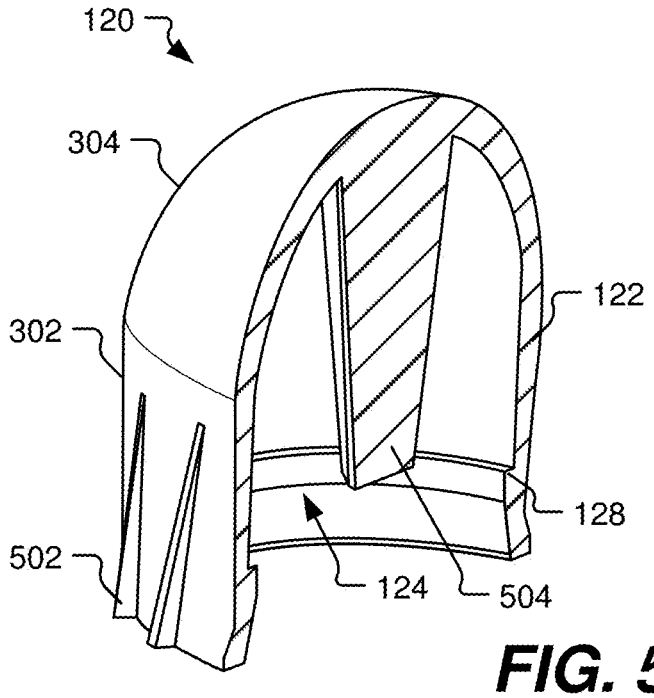
FIGS. 5A and 5B show schematic cross-sectional views of another example of the projectile of FIG. 1A.
Figure 5B:
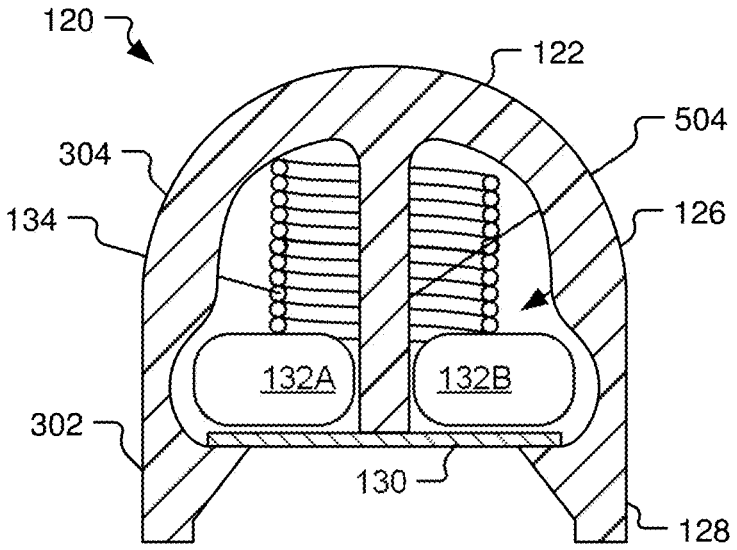

FIGS. 5A and 5B show schematic cross-sectional views of another example of the projectile 120 of FIG. 1A. The projectile 120 illustrated in FIGS. 5A and 5B includes the shell 122 defining the cavity 124, the retainer(s) 128, and the backplate 130. Additionally, as illustrated in FIG. 5B, the bolo 126 can be disposed within the cavity 124.

In FIGS. 5A and 5B, each of the retainer(s) 128 are illustrated as a ridge that extends around all or part of an inner circumference of the cavity 124. In other embodiments, each of the retainer(s) 128 of the projectile 120 of FIGS. 5A and 5B can include tabs, as illustrated in FIGS. 3A-3F, instead of one or more ridges.

The shell 122 of FIGS. 5A and 5B includes the nose cone 304 and the body 302. In the example illustrated in FIGS. 5A and 5B, the nose cone 304 does not include a recess (e.g., the recess 306 of FIGS. 3D-F) for a weight of the bolo 126. As a result, the weight(s) 132A and 132B of the bolo 126 is/are disposed within the cavity 124. In this example, the bolo 126 is configured to entirely separate from the shell 122 when deployed. Alternatively, a portion of the line 134 can pass through an opening of a structure 504 inside the cavity 124 such that when the bolo 126 is deployed, the shell 122 remains attached to the line 134. For example, the shell 122 attached to the line 134 can provide aerodynamic forces that tend to help the bolo 126 spread/splay.

The structure 504 disposed within the cavity 124 can help prevent or deter tangling of the line 134 before the bolo 126 is deployed. For example, the line 134 can be wound loosely around the structure 504 to reduce the likelihood of entanglement of the line 134. In some examples, the structure 504 can be arranged to press against the backplate 130 to urge the backplate 130 into contact with the retainer(s) 128.

In the example illustrated in FIG. 5A, the shell 122 also includes one or more aerodynamic features 502 configured to improve the accuracy, flight dynamics, or other flight characteristics of the projectile 120. For example, in FIG. 5A, the aerodynamic feature(s) 502 include fins that are curved or angled to induce spin in the projectile 120, similar to rifling within a barrel. In this example, the fins may improve the accuracy of the projectile 120, especially when the barrel 104 is smooth bored rather than rifled.

Figure 6A:
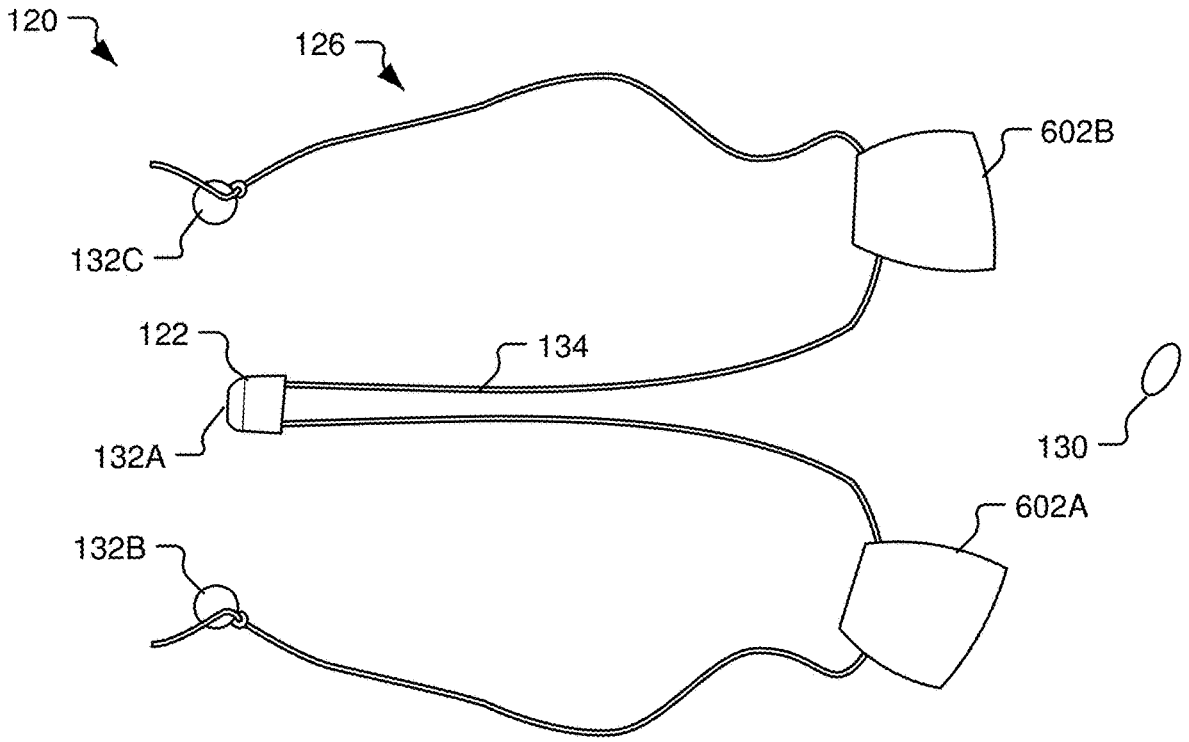
FIGS. 6A and 6B illustrate another particular example of the projectile of FIG. 1A.
Figure 6B:
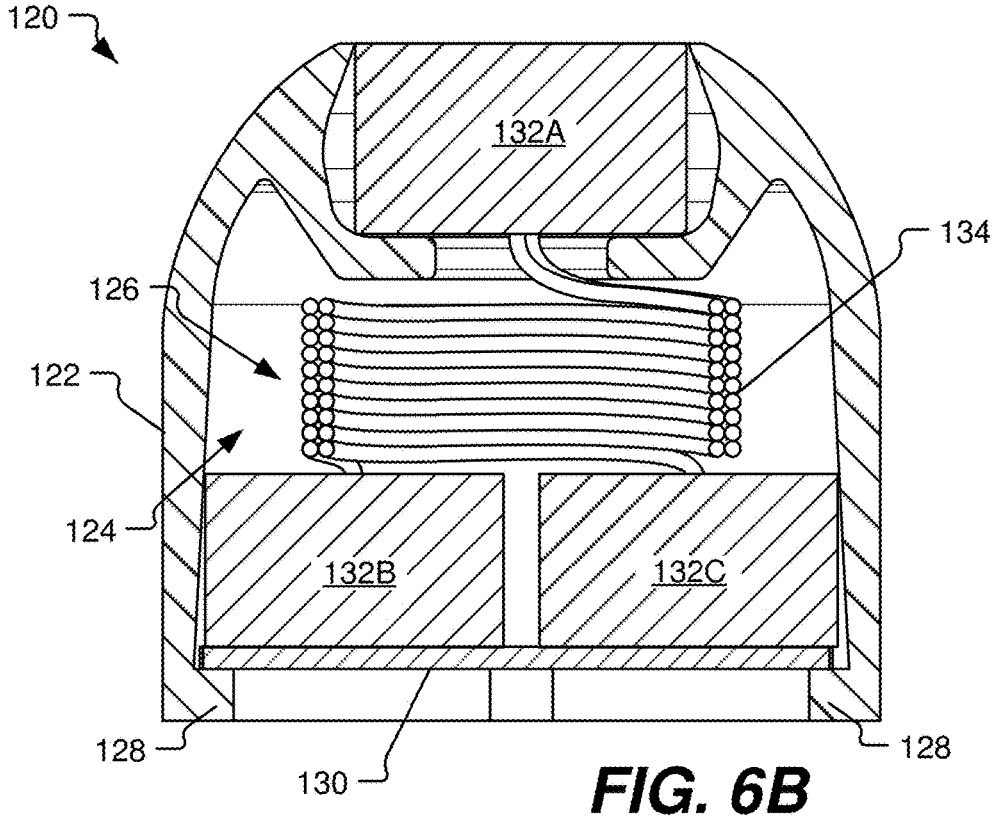

FIGS. 6A and 6B illustrate further examples of the projectile 120 of FIG. 1A. In FIGS. 6A and 6B, the bolo 126 is configured to deploy in a substantially W-shape, in contrast to the substantially U-shape illustrated in FIG. 2B.

The bolo 126 of FIGS. 6A and 6B includes at least three weights 132 (e.g., a weight 132A, a weight 132B, and a weight 132C). It is understood, however, that the number of weights 132 can be greater or less than what is depicted. In the example illustrated, the weight 132A is coupled to or integrated within the shell 122. Before the bolo 126 is deployed, as illustrated in the schematic cross-sectional view of FIG. 6B, the weights 132B and 132C are disposed within the cavity 124. In some embodiments, the bolo 126 includes two lines 134. In such embodiments, the weight 132A is coupled to one end of each of the lines 134, the weight 132B is coupled to the other end of a first of the lines 134, and the weight 132C is coupled to the other end of a second of the lines 134. Alternatively, the bolo 126 can include a single line 134 with the weight 132B coupled to one end of the line 134, the weight 132C coupled to the other end of the line 134, and the weight 132A coupled to the line 134 at some point between the two ends of the line 134. Arrangements with a different number and/or placement of the weights 132 on however many lines 134 (e.g., one, two, or more than two lines) are also possible.

The shell 122 of FIGS. 6A and 6B can be configured as described with reference to FIGS. 3A-3F. For example, the weight 132A can be disposed within the recess 306 of FIGS. 3D-3F, and the line(s) 134 can pass through the opening 308 of FIGS. 3D-3F to connect to the weights 132.

In the example illustrated in FIG. 6A, the bolo 126 also includes one or more stabilizers 602 (e.g., a stabilizer 602A and a stabilizer 602B) coupled to the line(s) 134. The stabilizer(s) 602 can be positioned along the line(s) 134 to improve aerodynamic forces (e.g., drag or lift) that in turn facilitate spreading of the bolo 126 or other desired flight characteristics, such as spinning. In some examples, the stabilizer(s) 602 can correspond to or include light weight, high drag components, such as ribbons, pieces of foam, additional unweighted lines, etc. In some such examples, before the bolo 126 is deployed, the stabilizer(s) 602 can be compressed within the cavity 124 in a manner that tends to urge the backplate 130 against the retainer(s) 128. Additionally, or alternatively, the stabilizer(s) 602 can be compressed within the cavity 124 in a manner that tends to facilitate separation of the backplate 130 from the shell 122 when the projectile 120 is deployed from a barrel.

Although not illustrated in FIGS. 6A and 6B, the shell 122 can include the aerodynamic features 502, the structure 504, or both, as described with reference to FIGS. 5A and 5B. Additionally, the retainer(s) 128 of the projectile 120 of FIGS. 6A and 6B can include tabs, ridges, or both.

Figure 7:
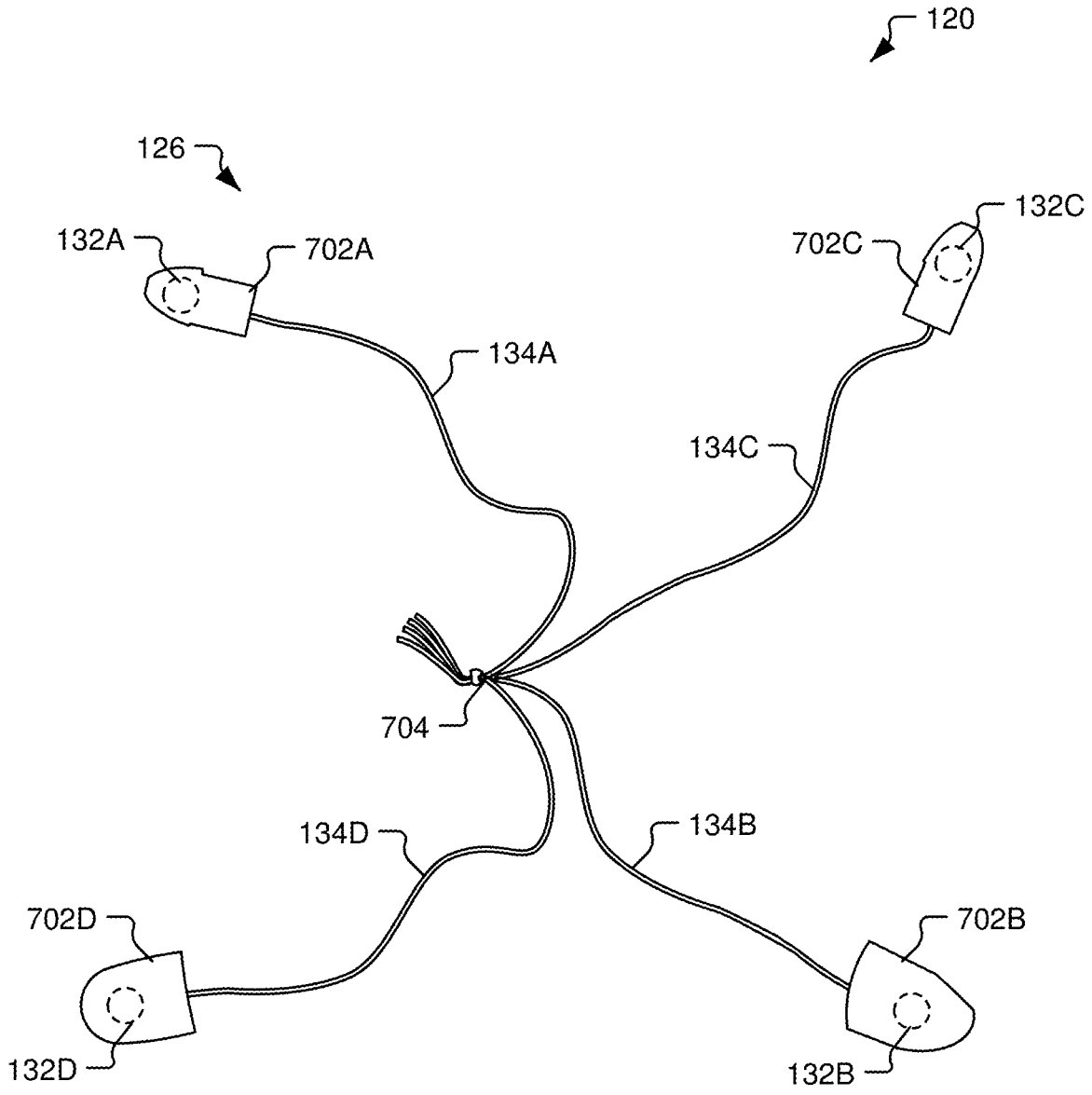
FIG. 7 illustrates another particular example of the projectile of FIG. 1A.

FIG. 7 illustrates an example of a bolo 126 that is configured to deploy in a substantially X-shape. For example, the bolo 126 of FIG. 7 includes four lines 134 (including line 134A, line 134B, line 134C, and line 134D). In FIG. 7, the lines 134 are joined to one another or to a hub at first ends 704. Second ends of the lines 134 are coupled to segments 702 of the shell 122 such that, when deployed, the lines 134 extend substantially radially outward from the first ends 704. In this example, the segments 702 are configured to separate from one another responsive to separation of the backplate 130 from the shell 122, as described further with reference to FIGS. 8A-10.

Although FIG. 7 illustrates an X-shaped bolo 126 that includes four lines 134, in other examples, the X-shaped bolo 126 of FIG. 7 can include two lines (rather than four). In such examples, each end of each of the lines 134 is coupled to a weight 132 or a segment 702 of the shell 122, and the lines 134 are tied to one another (or otherwise coupled) at a location along the length of each line 134. Although the X-shaped bolo 126 of FIG. 7 shows the weights 132 integrated within or coupled to the segments 702 of the shell 122, in other examples, the weights 132 can be separate from the shell 122 and configured to deploy as described with reference to any of FIGS. 1A-6B.

As described further below, the weights 132, the segments 702 of the shell 122, or both, can have an aerodynamic shape to facilitate spread of the bolo 126 to a target shape (e.g., the substantially X-shape illustrated in FIG. 7). For example, one or more of the segments 702, such as the segment 702A, can have a wedge shape or a lifting body shape that is configured, as the bolo 126 travels in a first direction, to generate a lateral force that causes an end of the line 134 coupled to the segment 702A to also move in a second direction lateral to the first direction to spread the bolo 126.

Figure 8A:
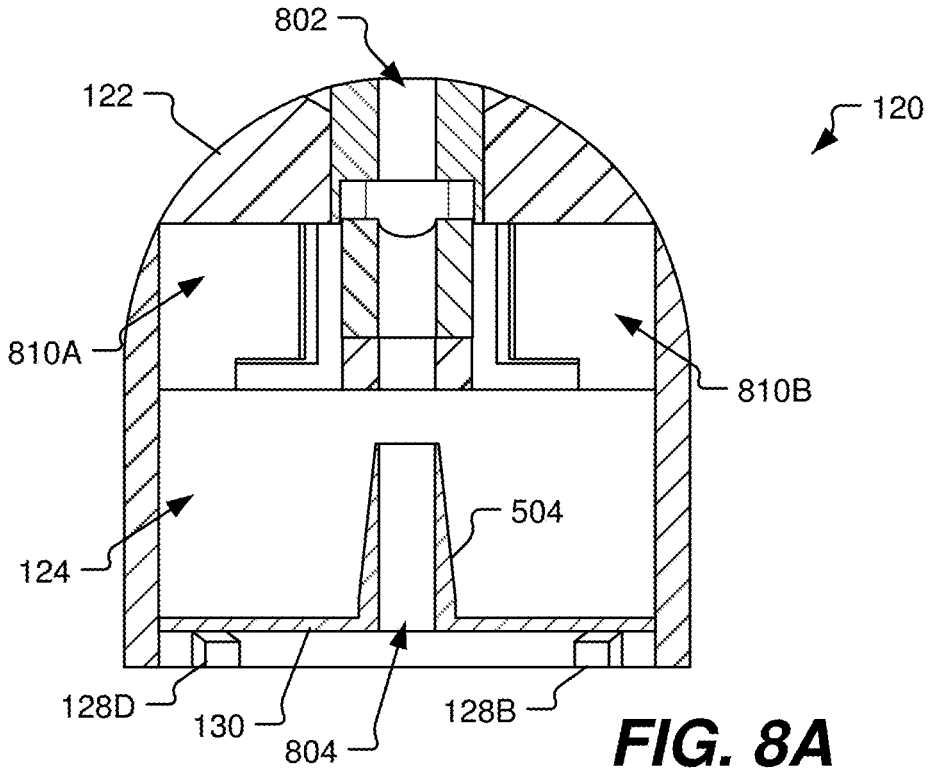
FIGS. 8A and 8B illustrate an example of the projectile of FIG. 1A in which the shell includes multiple segments.
Figure 8B:
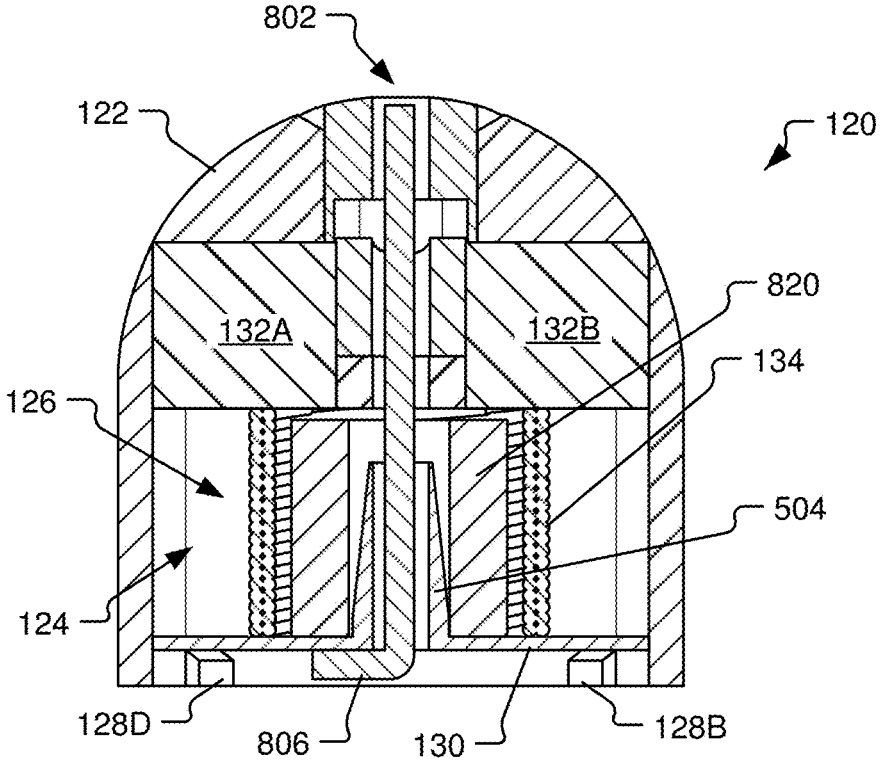
Figure 9A:
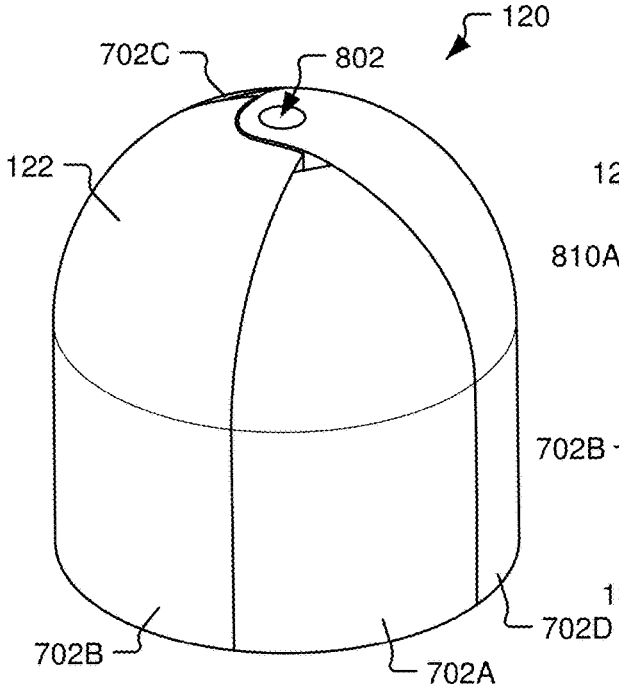
FIGS. 9A, 9B and 9C illustrate an example of a shell of the projectile of FIGS. 8A and 8B.
Figure 9B:
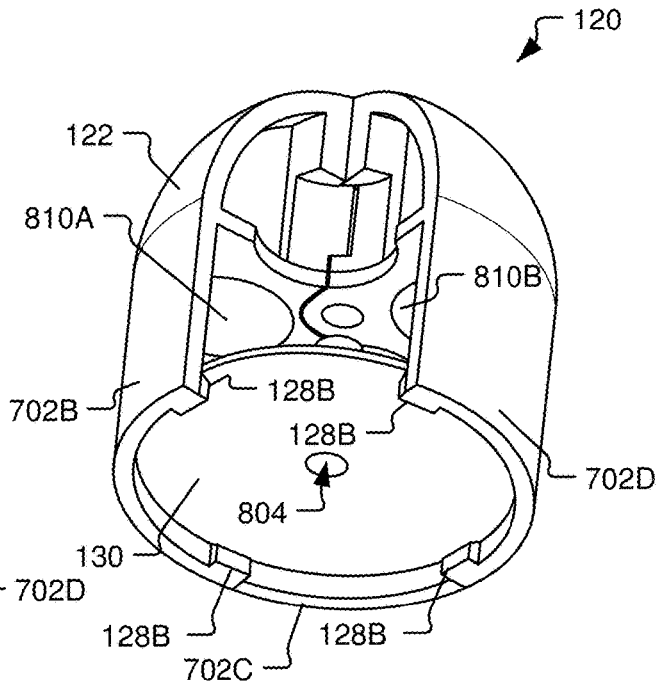
Figure 9C:
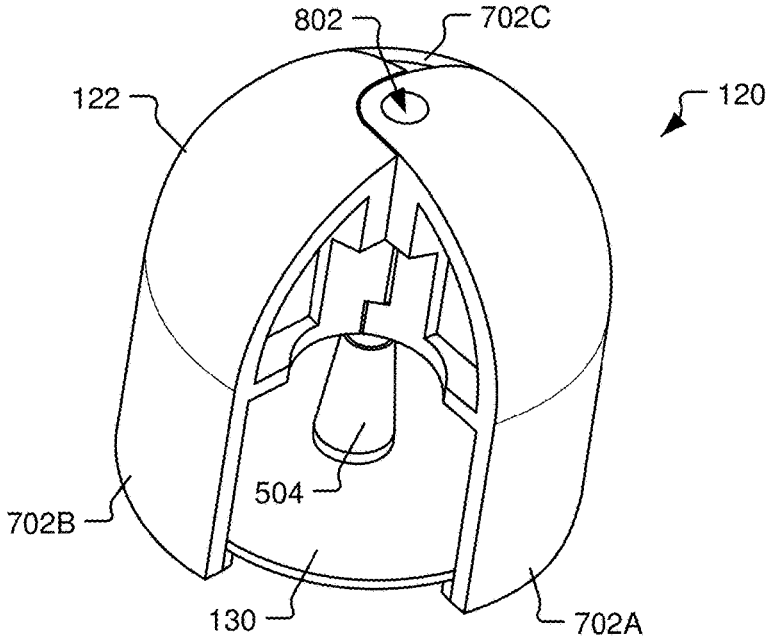
Figure 10:
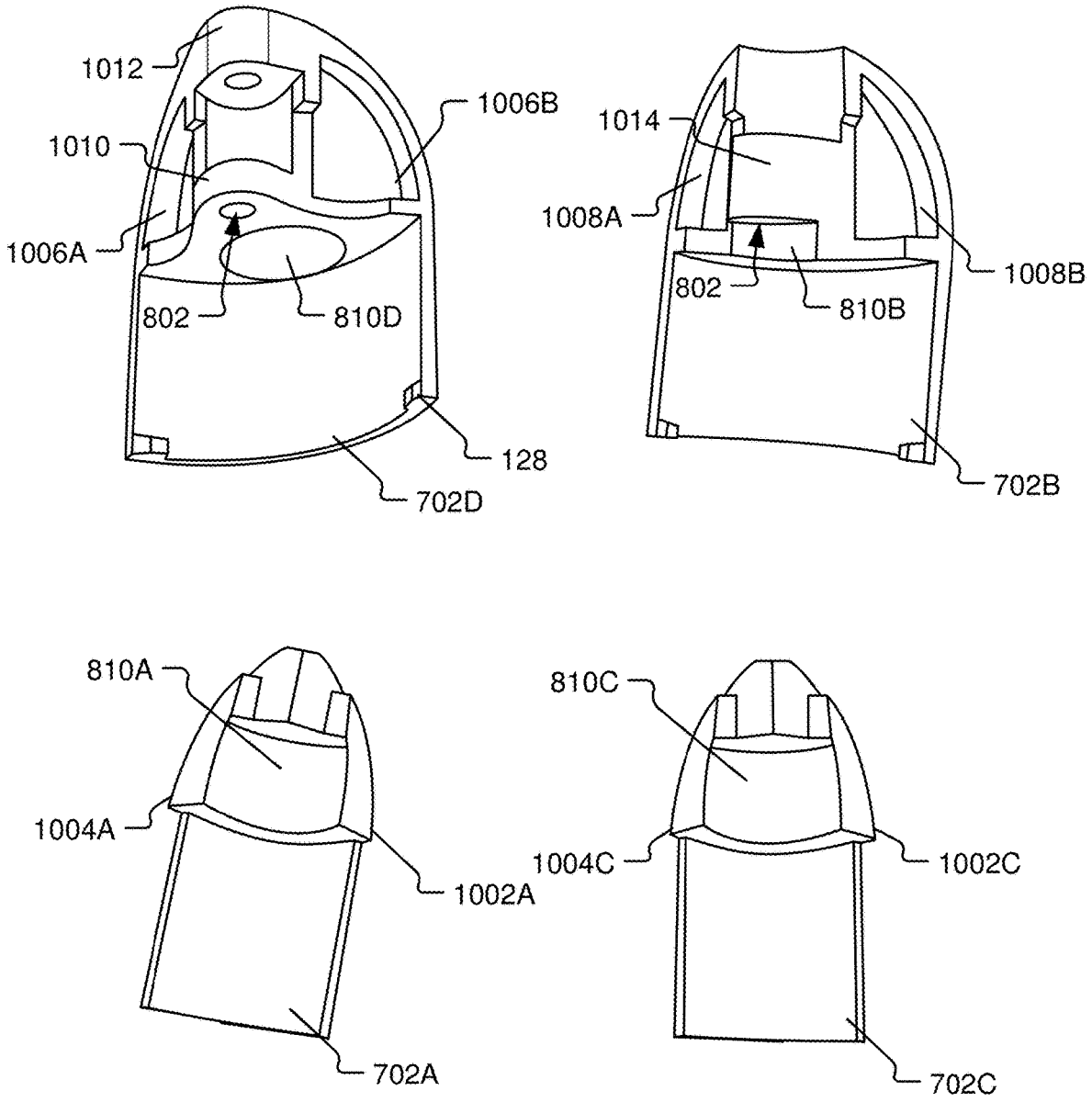
FIG. 10 illustrates an example of segments of the shell of the projectile of FIGS. 8A and 8B.

FIGS. 8A-10 illustrate various views of examples of the projectile 120 that include the segments 702 of FIG. 7. In particular, FIG. 8A illustrates a cross-sectional view of the shell 122 and backplate 130 of a particular example of the projectile 120, and FIG. 8B illustrates a cross-sectional view of the shell 122, the backplate 130, and pin 806 of the particular example of the projectile 120 of FIG. 8A. FIG. 9A illustrates a perspective view of a particular example of the shell 122 with all of the segments 702 assembled and in place, FIG. 9B illustrates a bottom perspective view of the shell 122 of FIG. 9A with a segment 702A removed to view interior components of the projectile 120, and FIG. 9C illustrates a top perspective view of the shell 122 of FIG. 9A with the segments 702A removed. FIG. 10 illustrates the segments 702 of a particular example of the shell 122 disassembled.

Referring to FIGS. 8A and 8B, the projectile 120 includes the shell 122 and the backplate 130 as described above. The shell 122 defines the cavity 124, which is configured to retain a bolo 126 (shown in FIG. 8B), and retainer(s) 128 to retain the backplate 130 before deployment of the projectile 120.

In FIGS. 8A and 8B, the shell 122 defines an opening 802 and the backplate 130 defines an opening 804. The openings 802, 804 are configured to receive a pin 806. The opening 802 is defined by multiple segments 702 of the shell 122 such that when the pin 806 is present within the opening 802, the pin 806 retains the segments 702 in an assembled configuration. Conversely, when the pin 806 is removed, the segments 702 are free to separate from one another. (Note that the individual segments 702 of the shell 122 are not labeled in FIGS. 8A and 8B, as the number and arrangement of the segments 702 can be different for different embodiments.) Although the opening 802 is illustrated in FIG. 8A as extending to the nose of the projectile 120, in other embodiments, the opening 802 need not extend to the nose of the projectile 120.

The opening 804 of the backplate 130 is configured to accept the pin 806 to allow the pin 806 to be positioned within the opening 802. The opening 804 and the pin 806 are configured such that when the backplate 130 separates from the shell 122, the pin 806 is removed from the opening 802 enabling separation of the segments 702 of the shell 122 from one another. Thus, the pin 806 and the backplate 130 cooperate as a mechanism configured to be actuated by relative motion during separation of the backplate 130 and the shell 122 to facilitate deployment of the bolo 126. In some embodiments, a weight 820 can be disposed near the backplate 130 to help separate the backplate 130 and the pin 806 from the shell 122.

One or more segments 702 of the shell 122 can define an opening 810 configured to receive a weight 132 of the bolo 126. For example, in FIG. 8A, the shell 122 includes an opening 810A to receive a weight 132A (shown in FIG. 8B) and an opening 810B to receive a weight 132B (shown in FIG. 8B).

In the example illustrated in FIGS. 8A and 8B, the backplate 130 includes a structure 504 that is disposed within the cavity 124 and configured to help prevent tangling of the line(s) 134 before the bolo 126 is deployed. For example, the line(s) 134 can be wound loosely around the structure 504 to reduce the likelihood of entanglement of the line(s) 134. In FIGS. 8A and 8B, the structure 504 can also reduce the likelihood of the pin 806 becoming entangled with the line(s) 134 of the bolo 126.

FIG. 9A illustrates a specific example of the projectile 120 of FIGS. 8A and 8B in which the shell 122 includes four segments 702 (including segments 702A, 702B, 702C, and 702D). In FIGS. 9B and 9C, the segment 702A and the pin 806 are omitted to display interior structures of the shell 122. The shell 122 of FIGS. 9A-9C includes the features described with reference to FIGS. 8A and 8B. For example, the shell 122 defines the opening 802, and the backplate 130 defines the opening 804. The shell 122 also defines openings 810 for weights 132 of the bolo 126. Further, as shown in FIG. 9C, the backplate 130 includes the structure 504.

FIG. 10 illustrates an example of the individual segments 702 of the projectile 120 of FIGS. 9A-9C. In the specific example illustrated, the shell 122 is formed by assembly of four segments 702 that include three different types of segments. For example, the shell 122 can be formed by assembly of the segment 702A, the segment 702B, the segment 702C, and the segment 702D, where the segments 702A and 702C are identical to one another. Additionally, in FIG. 10, each of the segments 702 defines a respective opening 810 for a weight 132 of the bolo 126 (not shown).

When the segments 702 illustrated in FIG. 10 are assembled to form the shell 122, a projection 1004C of the segment 702C is retained in an opening 1008B of the segment 702B, and a projection 1002C of the segment 702C is retained in an opening 1006A of the segment 702A. Similarly, a projection 1004A of the segment 702A is retained in an opening 1006B of the segment 702D, and a projection 1002A of the segment 702A is retained in an opening 1008A of the segment 702B. Further, a projection 1014 of the segment 702B is disposed between projections 1010 and 1012 of the segment 702D. After the segments 702 are positioned in this arrangement, the pin 806 (shown in FIG. 8B) can be inserted through the backplate 130 (shown in FIG. 8B) and through openings 802 in the segments 702D and 702B to retain the segments 702 in this assembled position with respect to one another. Subsequently, when the projectile 120 is deployed, imbalanced forces can cause the backplate 130 to separate from the shell 122, removing the pin 806. Removal of the pin 806 allows the segments 702 to separate from one another under the influence of forces resulting from deployment of the projectile 120 (e.g., differences between ambient air pressure and pressure within the cavity 124, spin of the projectile 120, aerodynamic forces, etc.).

The shell 122 of FIGS. 9A-9C, including four segments 702, may be suitable for deployment of a bolo 126 that is configured to deploy in a substantially X-shape, as illustrated in FIG. 7. In other embodiments, a shell 122 can include more than four segments 702 or fewer than four segments 702 for deployment of a bolo 126 that is configured to have a different deployed shape. For example, a shell 122 including three segments 702 can be used to deploy a bolo 126 having a substantially Y-shape. In other examples, shells 122 with more segments can be used to deploy bolos 126 having other shapes (e.g., substantially radial shapes with two or more arms extending from a center). Further, a number of arms of the bolos 126 can be different from a number of segments 702 of the shell 122. For example, a particular segment 702, or more than one segment 702, might not be coupled to a weight 132 of the bolo 126.

Thus, FIGS. 1A-10 illustrate various examples of projectiles 120 that are configured to deploy bolos 126 to engage a target, such as an aerial vehicle. The projectiles 120 disclosed are able to be deployed (e.g., fired) using an airgun, which can enable use of the projectiles 120 in situations where use of firearms would be prohibited or less desirable. Additionally, the projectiles 120 are breech-loadable and entirely clear the muzzle when deployed (e.g., fired) enabling firing of multiple projectiles 120 during an engagement.

Figure 11:
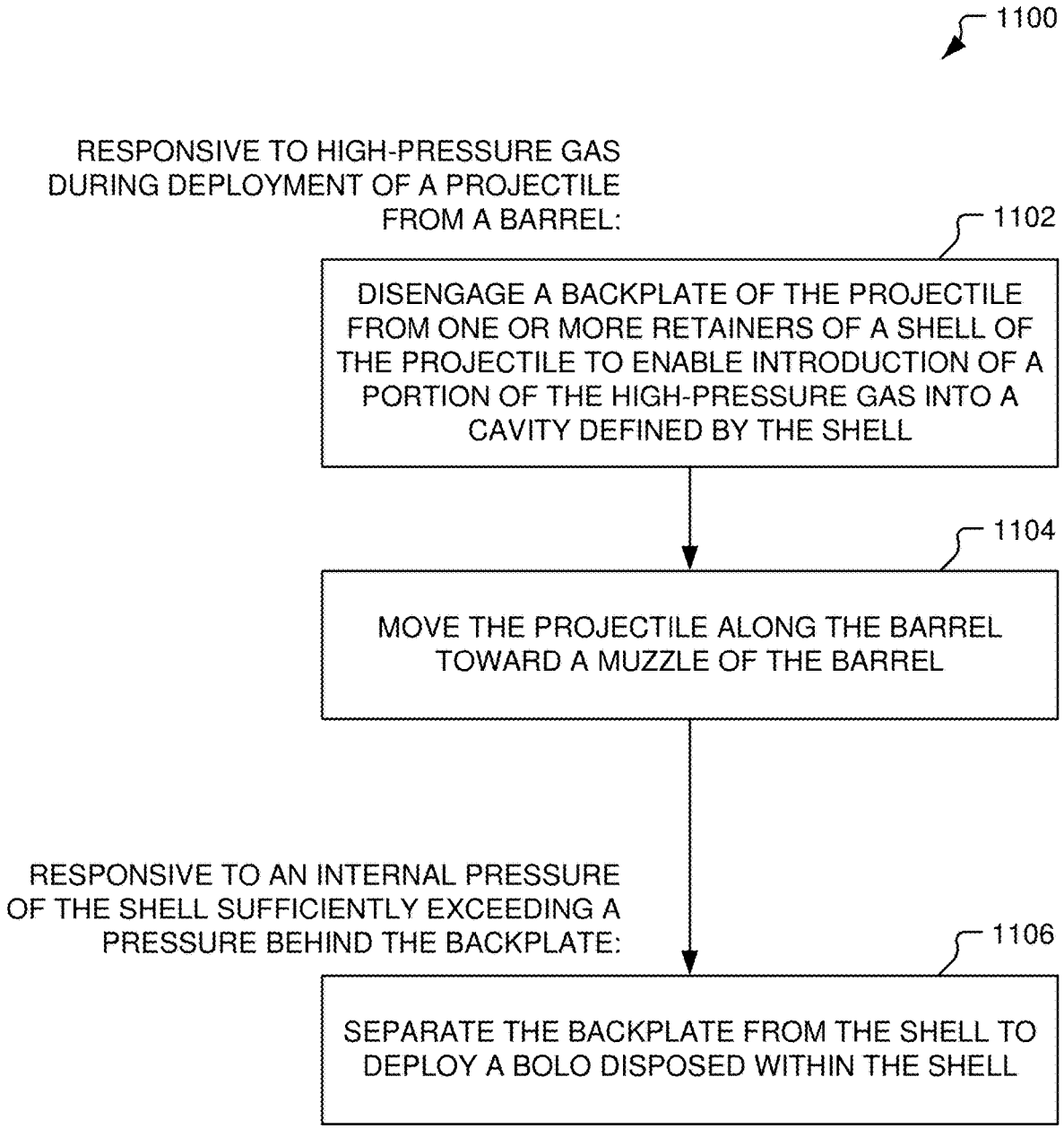
FIG. 11 is a flowchart of an example of a method of operation of the projectile of FIG. 1A.

FIG. 11 is a flowchart of an example of a method 1100 of operation of a projectile that deploys a bolo. The operations described with reference to FIG. 11 can be performed by any of the projectiles 120 of FIGS. 1A-10.

The method 1100 includes various operations that occur during deployment of the projectile. For example, in FIG. 11, responsive to high-pressure gas during deployment of a projectile from a barrel, the method 1100 includes, at block 1102, disengaging a backplate of the projectile from one or more retainers of a shell of the projectile to enable introduction of a portion of the high-pressure gas into a cavity defined by the shell. For example, the backplate 130 of FIG. 1A can disengage from the retainer(s) 128 of the shell 122 to enable introduction of high-pressure gas into the cavity 124. Responsive to the high-pressure gas during deployment of the projectile from the barrel, the method 1100 also includes, at block 1104, moving the projectile along the barrel toward a muzzle of the barrel. For example, the projectile 120A of FIG. 1A can move along the barrel 104 toward the muzzle 108. Particular aspects of the operations described with reference to blocks 1102 and 1104 are described further with reference to FIGS. 4A and 4B. In some embodiments, an entirety of the projectile is ejected from the muzzle of the barrel by the high-pressure gas.

The method 1100 of FIG. 11 also includes, at block 1106, responsive to an internal pressure of the shell sufficiently exceeding a pressure behind the backplate, separating the backplate from the shell to deploy a bolo disposed within the shell. For example, the backplate 130 of FIG. 1A can separate from the shell 122 to deploy the bolo 126. Particular aspects of the operations described with reference to block 1106 are described further with reference to FIG. 4C.

In some embodiments, the method 1100 also includes releasing one or more segment retainers of the projectile responsive to separation of the backplate from the shell. In such embodiments, the segment retainer(s) are configured to join multiple segments of the shell to one another before the projectile is deployed. For example, the segment retainer(s) can correspond to or include the pin 806 of FIG. 8B, which is configured to join multiple segments 702 of the shell 122 together before the projectile 120 is deployed. In this example, the pin 806 can be released responsive to separation of the backplate 130 from the shell 122.

In some such embodiments, after the one or more segment retainers are released and responsive, at least in part, to aerodynamic forces, the method 1100 includes separating the multiple segments of the shell from one another to spread the bolo. For example, in such embodiments, the segments 702 can be coupled to ends of line(s) 134 of the bolo 126 and the multiple segments are configured to generate a lateral force relative to the direction of motion of the projectile 120 before separation of the segments 702. In this example, the lateral force facilitate spreading of the bolo 126. Further, in this example, the method 1100 can include, responsive, at least in part, to aerodynamic forces, spreading the bolo to a deployed shape. To illustrate, the lateral force can include aerodynamic forces generated as a result of a shape of one or more of the segments 702.

In some embodiments, the backplate separates from the shell further responsive to forces applied to an interior surface of the backplate by a portion of the bolo. For example, as illustrated in FIGS. 4A-4C, a weight (e.g., the weight 132B) can be disposed adjacent to the backplate 130, in which case the weight 132B can press on an interior surface of the backplate 130 due to inertia of the weight 132B.

In some embodiments, the method 1100 also includes, before the high-pressure gas is released to deploy the projectile, moving the projectile from an ammunition feed system (e.g., a projectile clip or magazine) into a breach of the barrel via a receiver port. For example, the ammunition feed system 112 of FIG. 1A can move the projectile 120A into the breech 106 of the barrel 104 to prepare the projectile 120A to be fired from the airgun 102.

Particular aspects of the disclosure are described below in sets of interrelated Examples:

According to Example 1, a projectile includes a shell defining a cavity and one or more retainers; a bolo disposed within the cavity; and a backplate engaged with the one or more retainers and configured to separate from the shell to release the bolo in response to imbalanced forces resulting from deploying the projectile.

Example 2 includes the projectile of Example 1, wherein the bolo includes one or more lines coupled to two or more weights, and wherein at least a first weight of the two or more weights is attached to or integral with at least a portion of the shell.

Example 3 includes the projectile of Example 1 or Example 2, wherein at least a second weight of the two or more weights is not attached to and is not integral with any portion of the shell.

Example 4 includes the projectile of any of Examples 1 to 3, wherein the bolo includes two or more lines and two or more weights coupled to ends of the two or more lines.

Example 5 includes the projectile of any of Examples 1 to 4, wherein the bolo includes one or more lines, two or more weights coupled to the one or more lines, and one or more stabilizers coupled to the one or more lines and configured to facilitate spread of the bolo to a target shape.

Example 6 includes the projectile of any of Examples 1 to 5, wherein the bolo includes one or more lines and two or more weights coupled to the one or more lines, and wherein at least one weight of the two or more weights has an aerodynamic shape configured to generate a lateral force to improve spread of the bolo.

Example 7 includes the projectile of any of Examples 1 to 6, wherein the bolo is configured to deploy in a substantially U-shape, a substantially W-shape, or a substantially X-shape.

Example 8 includes the projectile of any of Examples 1 to 7, wherein the bolo is configured to deploy in a substantially radial shape having two or more arms extending from a center.

Example 9 includes the projectile of any of Examples 1 to 8, wherein the bolo is positioned in the shell in a manner that urges the backplate against the one or more retainers before the projectile is deployed.

Example 10 includes the projectile of any of Examples 1 to 9, wherein the one or more retainers include one or more tabs, one or more ridges, or both.

Example 11 includes the projectile of any of Examples 1 to 10, wherein the backplate is configured to, while traveling down a barrel during deployment of the projectile, permit high-pressure air to enter the cavity, and to, after exiting the barrel, flex to disengage from the one or more retainers due, at least in part, to a pressure differential between the high-pressure air in the cavity and ambient air pressure.

Example 12 includes the projectile of any of Examples 1 to 11, wherein a weight of the bolo is positioned within the cavity near a center of the backplate such that inertia of the weight tends to, while the projectile is traveling down a barrel during deployment of the projectile, flex the backplate to facilitate disengagement of the backplate from the one or more retainers.

Example 13 includes the projectile of any of Examples 1 to 12, wherein the shell includes one or more internal structures configured to inhibit entanglement of one or more lines of the bolo.

Example 14 includes the projectile of any of Examples 1 to 13 and further includes a mechanism configured to be actuated by relative motion during separation of the backplate and the shell.

Example 15 includes the projectile of any of Examples 1 to 14, wherein the shell includes multiple segments configured to separate from one another in response to separation of the backplate from the one or more retainers.

Example 16 includes the projectile of Example 15, wherein one or more of the multiple segments is coupled to a portion of the bolo and has an aerodynamic shape configured to generate a lateral force to improve spread of the bolo.

Example 17 includes the projectile of Example 15 or Example 16 and further includes one or more segment retainers coupled to the backplate and configured to join the multiple segments of the shell to one another before the projectile is deployed and configured to release the multiple segments from one another in response to separation of the backplate from the one or more retainers.

Example 18 includes the projectile of any of Examples 1 to 17, wherein the shell is configured to be breechloaded into a barrel.

Example 19 includes the projectile of Example 18, wherein the projectile is configured to, during deployment, exit the barrel entirely at a muzzle end of the barrel, leaving no component previously attached to the projectile in the barrel after deployment.

According to Example 20, a system includes a barrel including a breech and a muzzle; an ammunition feed system coupled to the barrel and configured to provide projectiles to the breech of the barrel; and one or more projectiles disposed within the ammunition feed system, the one or more projectiles includes a shell defining a cavity and one or more retainers; a bolo disposed within the cavity; and a backplate engaged with the one or more retainers and configured to separate from the shell to release the bolo in response to imbalanced forces resulting from deploying the projectile.

Example 21 includes the system of Example 20 and further includes a gun mount configured to enable mounting of the barrel to a vehicle.

Example 22 includes the system of Example 20 or Example 21 and further includes an aircraft, wherein the barrel is coupled to the aircraft to enable the aircraft to deploy the one or more projectiles at a target vehicle to entangle a propeller of the target vehicle.

Example 23 includes the system of any of Examples 20 to 22 and further includes a breechloading airgun that includes the barrel.

Example 24 includes the system of Example 23, wherein the airgun does not include an ejection system to remove a projectile casing after deployment of the projectile.

Example 25 includes the system of any of Examples 20 to 24, wherein, after a projectile of the one or more projectiles is deployed from the muzzle of the barrel, no component previously attached to the projectile remains in the barrel.

Example 26 includes the system of any of Examples 20 to 25, wherein the one or more projectiles are configured such that an entirety of each projectile exits the muzzle of the barrel during deployment of the projectile.

According to Example 27, a method of operation of a projectile includes, responsive to high-pressure gas during deployment of a projectile from a barrel disengaging a backplate of the projectile from one or more retainers of a shell of the projectile to enable introduction of a portion of the high-pressure gas into a cavity defined by the shell; moving the projectile along the barrel toward a muzzle of the barrel; and, responsive to an internal pressure of the shell sufficiently exceeding a pressure behind the backplate, separating the backplate from the shell to deploy a bolo disposed within the shell.

Example 28 includes the method of Example 27 and further includes releasing one or more segment retainers of the projectile responsive to separation of the backplate from the shell, wherein the one or more segment retainers are configured to join multiple segments of the shell to one another before the projectile is deployed.

Example 29 includes the method of Example 28 and further includes, after the one or more segment retainers are released and responsive, at least in part, to aerodynamic forces, separating the multiple segments of the shell from one another to spread the bolo.

Example 30 includes the method of any of Examples 27 to 29 and further includes, responsive at least in part to aerodynamic forces, spreading the bolo to a deployed shape.

Example 31 includes the method of any of Examples 27 to 30, wherein the backplate separates from the shell further responsive to forces applied to an interior surface of the backplate by a portion of the bolo.

Example 32 includes the method of any of Examples 27 to 31 and further includes, before the high-pressure gas is released to deploy the projectile, moving the projectile from an ammunition feed system into a breech of the barrel via a receiver port.

Example 33 includes the method of any of Examples 27 to 32, wherein an entirety of the projectile is ejected from the muzzle of the barrel by the high-pressure gas.

The illustrations of the examples described herein are intended to provide a general understanding of the structure of the various implementations. The illustrations are not intended to serve as a complete description of all of the elements and features of apparatus and systems that utilize the structures or methods described herein. Many other implementations may be apparent to those of skill in the art upon reviewing the disclosure. Other implementations may be utilized and derived from the disclosure, such that structural and logical substitutions and changes may be made without departing from the scope of the disclosure. For example, method operations may be performed in a different order than shown in the figures or one or more method operations may be omitted. Accordingly, the disclosure and the figures are to be regarded as illustrative rather than restrictive.

Moreover, although specific examples have been illustrated and described herein, it should be appreciated that any subsequent arrangement designed to achieve the same or similar results may be substituted for the specific implementations shown. This disclosure is intended to cover any and all subsequent adaptations or variations of various implementations. Combinations of the above implementations, and other implementations not specifically described herein, will be apparent to those of skill in the art upon reviewing the description.

The Abstract of the Disclosure is submitted with the understanding that it will not be used to interpret or limit the scope or meaning of the claims. In addition, in the foregoing Detailed Description, various features may be grouped together or described in a single implementation for the purpose of streamlining the disclosure. Examples described above illustrate but do not limit the disclosure. It should also be understood that numerous modifications and variations are possible in accordance with the principles of the present disclosure. As the following claims reflect, the claimed subject matter may be directed to less than all of the features of any of the disclosed examples. Accordingly, the scope of the disclosure is defined by the following claims and their equivalents.

What is claimed is:

1. A projectile comprising:

a shell defining a cavity and one or more retainers;

a bolo disposed within the cavity; and a backplate engaged with the one or more retainers and configured to separate from the shell to release the bolo in response to imbalanced forces resulting from deploying the projectile.

2. The projectile of claim 1, wherein the bolo comprises one or more lines coupled to two or more weights, and wherein at least a first weight of the two or more weights is attached to or integral with at least a portion of the shell.

3. The projectile of claim 2, wherein at least a second weight of the two or more weights is not attached to and is not integral with any portion of the shell.

4. The projectile of claim 1, wherein the bolo comprises two or more lines and two or more weights coupled to ends of the two or more lines.

5. The projectile of claim 1, wherein the bolo comprises one or more lines, two or more weights coupled to the one or more lines, and one or more stabilizers coupled to the one or more lines and configured to facilitate spread of the bolo to a target shape.

6. The projectile of claim 1, wherein the bolo comprises one or more lines and two or more weights coupled to the one or more lines, and wherein at least one weight of the two or more weights has an aerodynamic shape configured to generate a lateral force to improve spread of the bolo.

7. The projectile of claim 1, wherein the bolo is configured to deploy in a substantially U-shape, a substantially W-shape, or a substantially X-shape.

8. The projectile of claim 1, wherein the bolo is configured to deploy in a substantially radial shape having two or more arms extending from a center.

9. The projectile of claim 1, wherein the bolo is positioned in the shell in a manner that urges the backplate against the one or more retainers before the projectile is deployed.

10. The projectile of claim 1, wherein the one or more retainers include one or more tabs, one or more ridges, or both.

11. The projectile of claim 1, wherein the backplate is configured to, while traveling down a barrel during deployment of the projectile, permit high-pressure air to enter the cavity, and to, after exiting the barrel, flex to disengage from the one or more retainers due, at least in part, to a pressure differential between the high-pressure air in the cavity and ambient air pressure.

12. The projectile of claim 1, wherein a weight of the bolo is positioned within the cavity near a center of the backplate such that inertia of the weight tends to, while the projectile is traveling down a barrel during deployment of the projectile, flex the backplate to facilitate disengagement of the backplate from the one or more retainers.

13. The projectile of claim 1, wherein the shell comprises one or more internal structures configured to inhibit entanglement of one or more lines of the bolo.

14. The projectile of claim 1, further comprising a mechanism configured to be actuated by relative motion during separation of the backplate and the shell.

15. The projectile of claim 1, wherein the shell comprises multiple segments configured to separate from one another in response to separation of the backplate from the one or more retainers.

16. The projectile of claim 15, wherein one or more of the multiple segments is coupled to a portion of the bolo and has an aerodynamic shape configured to generate a lateral force to improve spread of the bolo.

17. The projectile of claim 15, further comprising one or more segment retainers coupled to the backplate and configured to join the multiple segments of the shell to one another before the projectile is deployed and configured to release the multiple segments from one another in response to separation of the backplate from the one or more retainers.

18. The projectile of claim 1, wherein a system comprises the projectile, wherein the system further comprises:

a barrel comprising a breech and a muzzle; and an ammunition feed system coupled to the barrel and configured to provide projectiles to the breech of the barrel, wherein the projectile is disposed within the ammunition feed system, wherein the shell is configured to be breechloaded into the barrel.

19. The projectile of claim 18, wherein the projectile is configured to, during deployment, exit the barrel entirely at a muzzle end of the barrel, leaving no component previously attached to the projectile in the barrel after deployment.

20. A system comprising:

a barrel comprising a breech and a muzzle;

an ammunition feed system coupled to the barrel and configured to provide projectiles to the breech of the barrel; and one or more projectiles disposed within the ammunition feed system, the one or more projectiles comprising:

a shell defining a cavity and one or more retainers;

a bolo disposed within the cavity; and a backplate engaged with the one or more retainers and configured to separate from the shell to release the bolo in response to imbalanced forces resulting from deploying the projectile.

21. The system of claim 20, further comprising a gun mount configured to enable mounting of the barrel to a vehicle.

22. The system of claim 20, further comprising an aircraft, wherein the barrel is coupled to the aircraft to enable the aircraft to deploy the one or more projectiles at a target vehicle to entangle a propeller of the target vehicle.

23. The system of claim 20, further comprising a breechloading airgun that includes the barrel.

24. The system of claim 23, wherein the airgun does not include an ejection system to remove a projectile casing after deployment of the projectile.

25. The system of claim 20, wherein, after a projectile of the one or more projectiles is deployed from the muzzle of the barrel, no component previously attached to the projectile remains in the barrel.

26. The system of claim 20, wherein the one or more projectiles are configured such that an entirety of each projectile exits the muzzle of the barrel during deployment of the projectile.

27. A method of operation of a projectile, the method comprising:

responsive to high-pressure gas during deployment of a projectile from a barrel:

disengaging a backplate of the projectile from one or more retainers of a shell of the projectile to enable introduction of a portion of the high-pressure gas into a cavity defined by the shell; and moving the projectile along the barrel toward a muzzle of the barrel; and responsive to an internal pressure of the shell sufficiently exceeding a pressure behind the backplate, separating the backplate from the shell to deploy a bolo disposed within the shell.

28. The method of claim 27, further comprising releasing one or more segment retainers of the projectile responsive to separation of the backplate from the shell, wherein the one or more segment retainers are configured to join multiple segments of the shell to one another before the projectile is deployed.

29. The method of claim 28, further comprising, after the one or more segment retainers are released and responsive, at least in part, to aerodynamic forces, separating the multiple segments of the shell from one another to spread the bolo.

30. The method of claim 27, further comprising, responsive at least in part to aerodynamic forces, spreading the bolo to a deployed shape.

31. The method of claim 27, wherein the backplate separates from the shell further responsive to forces applied to an interior surface of the backplate by a portion of the bolo.

32. The method of claim 27, further comprising, before the high-pressure gas is released to deploy the projectile, moving the projectile from an ammunition feed system into a breech of the barrel via a receiver port.

33. The method of claim 27, wherein an entirety of the projectile is ejected from the muzzle of the barrel by the high-pressure gas.

* * * * *